US010344578B2

(12) United States Patent
Hann et al.

(10) Patent No.: US 10,344,578 B2
(45) Date of Patent: Jul. 9, 2019

(54) HYDROCARBON RECOVERY SYSTEM WITH SLIDABLE CONNECTORS AND RELATED METHODS

(71) Applicant: HARRIS CORPORATION, Melbourne, FL (US)

(72) Inventors: Murray T. Hann, Malabar, FL (US); Brian N. Wright, Indialantic, FL (US); Verlin A. Hibner, Melbourne Beach, FL (US)

(73) Assignee: HARRIS CORPORATION, Melbourne, FL (US)

( * ) Notice: Subject to any disclaimer, the term of this patent is extended or adjusted under 35 U.S.C. 154(b) by 214 days.

(21) Appl. No.: 15/426,168

(22) Filed: Feb. 7, 2017

(65) Prior Publication Data

US 2018/0223639 A1 Aug. 9, 2018

(51) Int. Cl.

| | |
|---|---|
| ***E21B 43/24*** | (2006.01) |
| ***H01Q 1/46*** | (2006.01) |
| ***H01Q 19/09*** | (2006.01) |

(52) U.S. Cl.

CPC ..... *E21B 43/2401* (2013.01); *H01Q 1/46* (2013.01); *H01Q 19/09* (2013.01)

(58) Field of Classification Search

CPC .. E21B 43/24; E21B 43/2401; E21B 43/2406; E21B 43/2408; E21B 34/06; E21B 34/12; E21B 36/00; E21B 36/04

See application file for complete search history.

(56) References Cited

U.S. PATENT DOCUMENTS

| | | | | |
|---|---|---|---|---|
| 7,441,597 | B2 | 10/2008 | Kasevich | |
| 7,891,421 | B2 | 2/2011 | Kasevich | |
| 9,376,897 | B2 | 6/2016 | Ayers et al. | |
| 2010/0078163 | A1 | 4/2010 | Banerjee et al. | |
| 2010/0294488 | A1 | 11/2010 | Wheeler et al. | |
| 2010/0294489 | A1 | 11/2010 | Dreher, Jr. et al. | |
| 2014/0224472 | A1* | 8/2014 | Parsche | H01Q 9/16 166/60 |
| 2016/0245059 | A1* | 8/2016 | Wright | E21B 43/2401 |

* cited by examiner

*Primary Examiner* — Brad Harcourt
*Assistant Examiner* — David Carroll
(74) *Attorney, Agent, or Firm* — Allen, Dyer, Doppelt + Gilchrist, P.A.

(57) ABSTRACT

An RF antenna assembly may include first and second tubular conductors, a dielectric isolator, and first and second electrical contact sleeves respectively coupled between the first and second tubular conductors and the dielectric isolator. The RF antenna assembly may include an RF transmission line having an inner conductor and an outer conductor extending within the first tubular conductor, and a feed structure coupled to a distal end of the RF transmission line. The feed structure may include a first radially compressible connector coupled to the outer conductor of the RF transmission line to slidably engage adjacent portions of the first electrical contact sleeve, a second radially compressible connector coupled to the inner conductor of the RF transmission line to slidably engage adjacent portions of the second electrical contact sleeve, and a dielectric tube coupled between the first and second radially compressible connectors.

24 Claims, 21 Drawing Sheets

HYDROCARBON RECOVERY SYSTEM WITH SLIDABLE CONNECTORS AND RELATED METHODS

TECHNICAL FIELD

The present invention relates to the field of hydrocarbon resource processing, and, more particularly, to an antenna assembly isolator and related methods.

BACKGROUND

Energy consumption worldwide is generally increasing, and conventional hydrocarbon resources are being consumed. In an attempt to meet demand, the exploitation of unconventional resources may be desired. For example, highly viscous hydrocarbon resources, such as heavy oils, may be trapped in sands where their viscous nature does not permit conventional oil well production. This category of hydrocarbon resource is generally referred to as oil sands. Estimates are that trillions of barrels of oil reserves may be found in such oil sand formations.

In some instances, these oil sand deposits are currently extracted via open-pit mining. Another approach for in situ extraction for deeper deposits is known as Steam-Assisted Gravity Drainage (SAGD). The heavy oil is immobile at reservoir temperatures, and therefore, the oil is typically heated to reduce its viscosity and mobilize the oil flow. In SAGD, pairs of injector and producer wells are formed to be laterally extending in the ground. Each pair of injector/producer wells includes a lower producer well and an upper injector well. The injector/production wells are typically located in the payzone of the subterranean formation between an underburden layer and an overburden layer.

The upper injector well is used to typically inject steam, and the lower producer well collects the heated crude oil or bitumen that flows out of the formation, along with any water from the condensation of injected steam. The injected steam forms a steam chamber that expands vertically and horizontally in the formation. The heat from the steam reduces the viscosity of the heavy crude oil or bitumen, which allows it to flow down into the lower producer well where it is collected and recovered. The steam and gases rise due to their lower density. Gases, such as methane, carbon dioxide, and hydrogen sulfide, for example, may tend to rise in the steam chamber and fill the void space left by the oil defining an insulating layer above the steam. Oil and water flow is by gravity driven drainage urged into the lower producer well.

Operating the injection and production wells at approximately reservoir pressure may address the instability problems that adversely affect high-pressure steam processes. SAGD may produce a smooth, even production that can be as high as 70% to 80% of the original oil in place (OOIP) in suitable reservoirs. The SAGD process may be relatively sensitive to shale streaks and other vertical barriers since, as the rock is heated, differential thermal expansion causes fractures in it, allowing steam and fluids to flow through. SAGD may be twice as efficient as the older cyclic steam stimulation (CSS) process.

Many countries in the world have large deposits of oil sands, including the United States, Russia, and various countries in the Middle East. Oil sands may represent as much as two-thirds of the world's total petroleum resource, with at least 1.7 trillion barrels in the Canadian Athabasca Oil Sands, for example. At the present time, only Canada has a large-scale commercial oil sands industry, though a small amount of oil from oil sands is also produced in Venezuela. Because of increasing oil sands production, Canada has become the largest single supplier of oil and products to the United States. Oil sands now are the source of almost half of Canada's oil production, while Venezuelan production has been declining in recent years. Oil is not yet produced from oil sands on a significant level in other countries.

U.S. Published Patent Application No. 2010/0078163 to Banerjee et al. discloses a hydrocarbon recovery process whereby three wells are provided: an uppermost well used to inject water, a middle well used to introduce microwaves into the reservoir, and a lowermost well for production. A microwave generator generates microwaves which are directed into a zone above the middle well through a series of waveguides. The frequency of the microwaves is at a frequency substantially equivalent to the resonant frequency of the water so that the water is heated.

Along these lines, U.S. Published Patent Application No. 2010/0294489 to Dreher, Jr. et al. discloses using microwaves to provide heating. An activator is injected below the surface and is heated by the microwaves, and the activator then heats the heavy oil in the production well. U.S. Published Patent Application No. 2010/0294488 to Wheeler et al. discloses a similar approach.

U.S. Pat. No. 7,441,597 to Kasevich discloses using a radio frequency generator to apply radio frequency (RF) energy to a horizontal portion of an RF well positioned above a horizontal portion of an oil/gas producing well. The viscosity of the oil is reduced as a result of the RF energy, which causes the oil to drain due to gravity. The oil is recovered through the oil/gas producing well.

U.S. Pat. No. 7,891,421, also to Kasevich, discloses a choke assembly coupled to an outer conductor of a coaxial cable in a horizontal portion of a well. The inner conductor of the coaxial cable is coupled to a contact ring. An insulator is between the choke assembly and the contact ring. The coaxial cable is coupled to an RF source to apply RF energy to the horizontal portion of the well.

Unfortunately, long production times, for example, due to a failed start-up, to extract oil using SAGD may lead to significant heat loss to the adjacent soil, excessive consumption of steam, and a high cost for recovery. Significant water resources are also typically used to recover oil using SAGD, which impacts the environment. Limited water resources may also limit oil recovery. SAGD is also not an available process in permafrost regions, for example, or in areas that may lack sufficient cap rock, are considered "thin" payzones, or payzones that have interstitial layers of shale. While RF heating may address some of these shortcomings, further improvements to RF heating may be desirable. For example, it may be relatively difficult to install or integrate RF heating equipment into existing wells.

SUMMARY

In view of the foregoing background, it is therefore an object of the present disclosure to provide a hydrocarbon recovery system that is efficient and robust.

This and other objects, features, and advantages in accordance with the present disclosure are provided by a hydrocarbon recovery system comprising an RF source, and an RF antenna assembly coupled to the RF source and within a wellbore in a subterranean formation for hydrocarbon resource recovery. The RF antenna assembly may include first and second tubular conductors, a dielectric isolator, and first and second electrical contact sleeves respectively coupled between the first and second tubular conductors and the dielectric isolator so that the first and second tubular conductors define a dipole antenna. The RF antenna assembly may comprise an RF transmission line comprising an inner conductor and an outer conductor extending within the first tubular conductor, and a feed structure coupled to a distal end of the RF transmission line. The feed structure may comprise a first radially compressible connector coupled to the outer conductor of the RF transmission line to slidably engage adjacent portions of the first electrical contact sleeve. The feed structure may also comprise a second radially compressible connector coupled to the inner conductor of the RF transmission line to slidably engage adjacent portions of the second electrical contact sleeve, and a dielectric tube coupled between the first and second radially compressible connectors. Advantageously, the RF antenna assembly may be readily assembled within the wellbore.

Additionally, the first electrical contact sleeve may comprise a first outer sleeve and a first inner electrically conductive liner therein, and the second electrical contact sleeve may comprise a second outer sleeve and a second inner electrically conductive liner therein. The first and second inner electrically conductive liners may each comprise stainless steel. The first radially compressible connector may comprise a plurality of first watchband springs, and the second radially compressible connector may comprise a plurality of second watchband springs.

In some embodiments, the RF antenna assembly may include a plurality of first seals associated with the plurality of first watchband springs, and a plurality of second seals associated with the plurality of second watchband springs. More specifically, the dielectric isolator may comprise a tubular dielectric member and a polytetrafluoroethylene (PTFE) coating thereon. The tubular dielectric member may comprise cyanate ester. The RF antenna assembly may comprise an insulating coating on the first and second electrical contact sleeves and at least a portion of the first and second tubular conductors. For example, the insulating coating may comprise PTFE.

Another aspect is directed to an RF antenna assembly to be positioned within a wellbore in a subterranean formation for hydrocarbon resource recovery. The RF antenna assembly may include first and second tubular conductors, a dielectric isolator, and first and second electrical contact sleeves respectively coupled between the first and second tubular conductors and the dielectric isolator so that the first and second tubular conductors define a dipole antenna. The RF antenna assembly may include an RF transmission line comprising an inner conductor and an outer conductor extending within the first tubular conductor, and a feed structure coupled to a distal end of the RF transmission line. The feed structure may include a first radially compressible connector coupled to the outer conductor of the RF transmission line to slidably engage adjacent portions of the first electrical contact sleeve, a second radially compressible connector coupled to the inner conductor of the RE transmission line to slidably engage adjacent portions of the second electrical contact sleeve, and a dielectric tube coupled between the first and second radially compressible connectors.

Yet another aspect is directed to a method for making an RF antenna assembly positioned within a wellbore in a subterranean formation for hydrocarbon resource recovery. The method may include positioning first and second tubular conductors, first and second electrical contact sleeves, and a dielectric isolator in the wellbore and so that the first and second electrical contact sleeves are respectively coupled between the first and second tubular conductors and the dielectric isolator. The first and second tubular conductors may define a dipole antenna. The method may include coupling a feed structure to a distal end of an RF transmission line. The RF transmission line may include an inner conductor and an outer conductor. The feed structure may include a first radially compressible connector coupled to the outer conductor of the RF transmission line to slidably engage adjacent portions of the first electrical contact sleeve, a second radially compressible connector coupled to the inner conductor of the RF transmission line to slidably engage adjacent portions of the second electrical contact sleeve, and a dielectric tube coupled between the first and second radially compressible connectors. The method may include positioning the RF transmission line within the wellbore and extending within the first tubular conductor.

DETAILED DESCRIPTION

The present disclosure will now be described more fully hereinafter with reference to the accompanying drawings, in which several embodiments of the invention are shown. This present disclosure may, however, be embodied in many different forms and should not be construed as limited to the embodiments set forth herein. Rather, these embodiments are provided so that this disclosure will be thorough and complete, and will fully convey the scope of the present disclosure to those skilled in the art. Like numbers refer to like elements throughout.

In typical hydrocarbon recovery via RF heating, in order to heat surrounding media and more easily facilitate extraction of hydrocarbon product from the ground, an antenna is deployed underground in proximity to an oil well producer, necessitating an electrically insulative, non-energy absorbing structural element to support the radiating components of a center-feed, dipole antenna assembly. The dipole antenna assembly may need a design: with minimal dielectric heating; that can survive extreme temperatures; and that can survive exposure to environmental fluids (i.e. corrosive materials) while maintaining structural integrity and preventing arcing between elements at high RF power.

Figure 1:
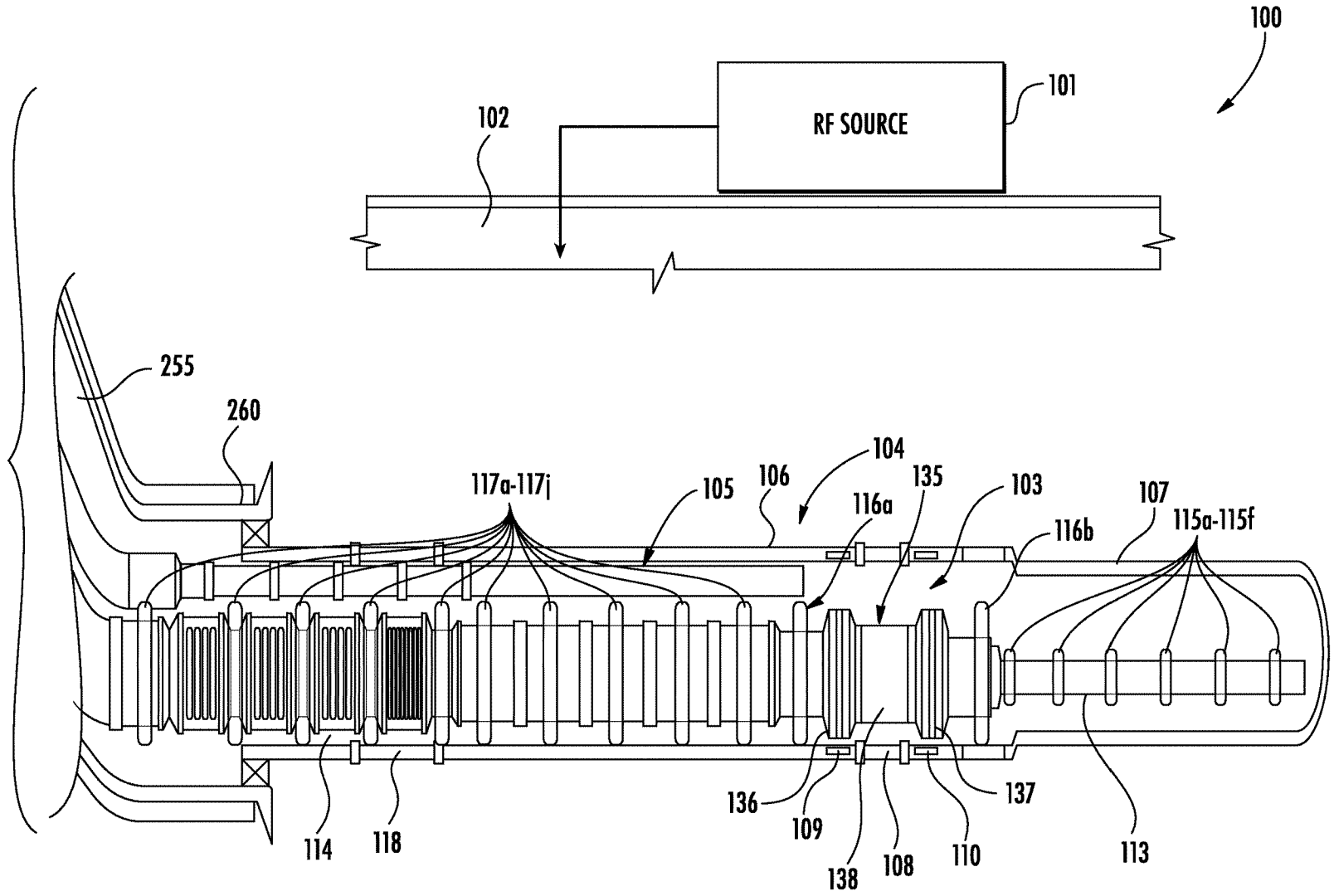
FIG. 1 is a schematic diagram of a hydrocarbon recovery system, according to the present disclosure.

Referring initially to FIG. 1, a hydrocarbon recovery system 100 according to the present disclosure is now described. The hydrocarbon recovery system 100 illustratively includes an RE source (e.g. an RE transmitter) 101, and an RF antenna assembly 104 coupled to the RF source and within a wellbore 255 in a subterranean formation 102 for hydrocarbon resource recovery. The hydrocarbon recovery system 100 illustratively includes a solvent injector well 105 extending within the wellbore 255 adjacent the RF antenna assembly 104 and configured to apply solvent fluids to the wellbore. In some embodiments, the hydrocarbon resources are recovered directly through the RF antenna assembly 104, but in other embodiments, a separate producer well may be deployed.

The RF antenna assembly 104 illustratively includes first and second tubular conductors (e.g. comprising high strength steel) 106, 107, a dielectric isolator 108, and first and second electrical contact sleeves (e.g. comprising high strength steel) 109, 110 respectively coupled between the first and second tubular conductors and the dielectric isolator so that the first and second tubular conductors define a dipole antenna. The hydrocarbon recovery system 100 illustratively includes a debris seal packer 260 between an intermediate casing, upward portion of the wellbore 255, and the RF antenna assembly 104.

Figure 11:
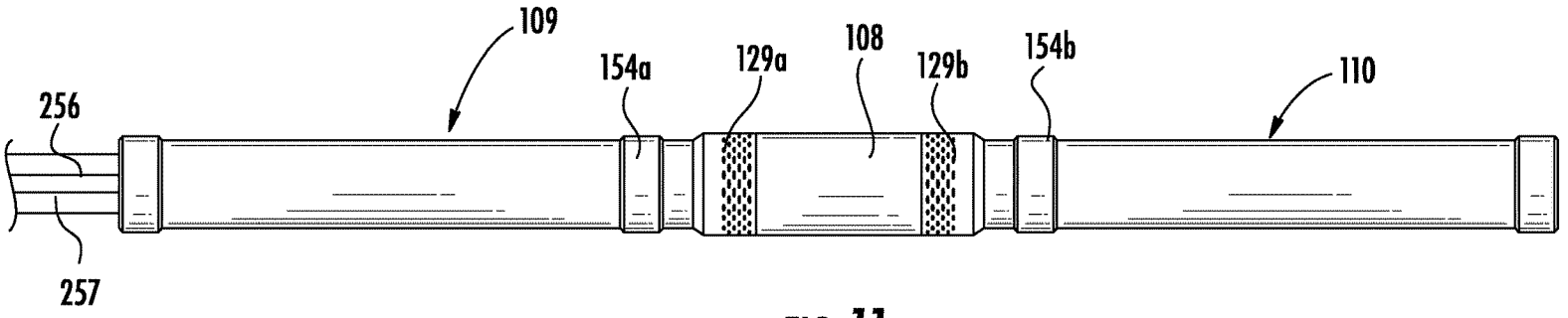
FIG. 11 is a side elevational view of a RF antenna assembly from the hydrocarbon recovery system of FIG. 1.
Figure 12:
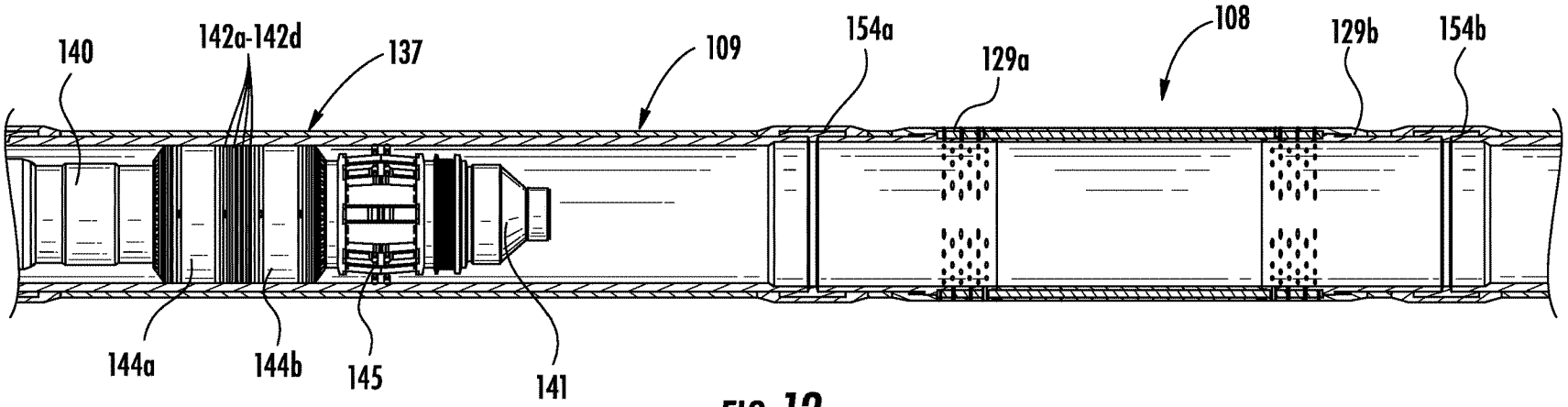
FIGS. 12-14 are partial cross-sectional views of the RF antenna assembly from FIG. 4 with the RF transmission line therein.
Figure 13:
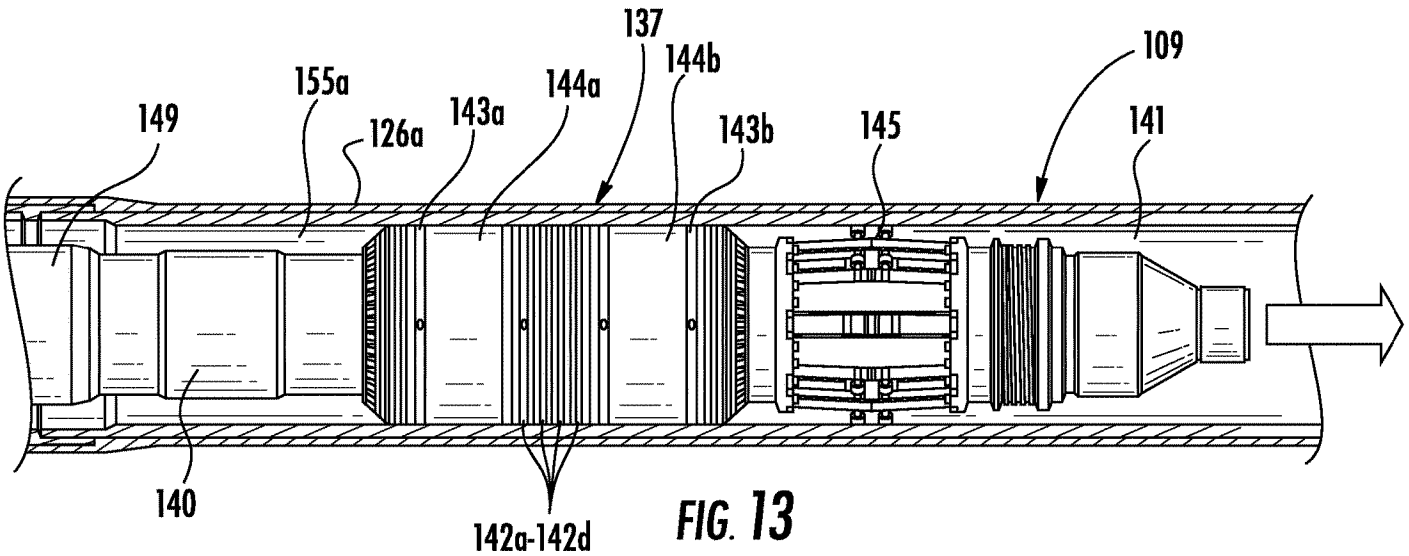
Figure 14:
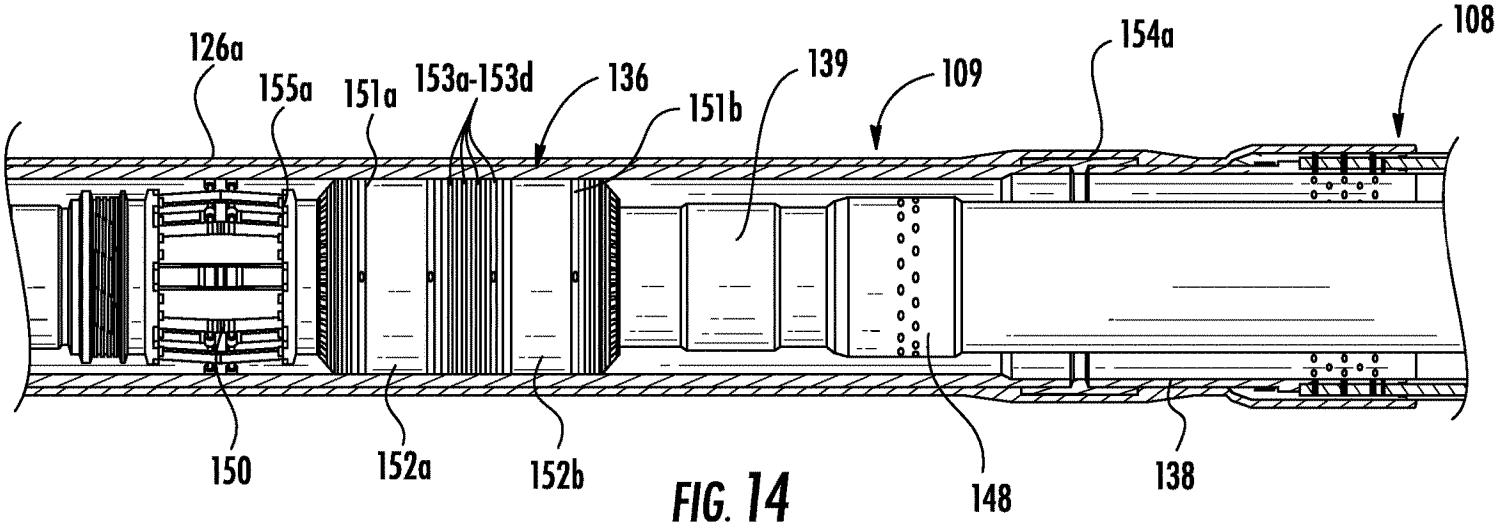

The RF antenna assembly 104 illustratively includes an RF transmission line 103 comprising an inner conductor 257 (FIG. 11) and an outer conductor 256 (FIG. 11) extending within the first tubular conductor 106. The RF antenna assembly 104 illustratively includes a plurality of tool centralizers 117*f*-117*j*, 116*a*-116*b*, 115*a*-115*f*, which maintain a position of the RF transmission line 103 in the wellbore 255. The plurality of tool centralizers 117*f*-117*j*, 116*a*-116*b*, 115*a*-115*f* is positioned within the first and second tubular conductors 106, 107, longitudinally spaced apart on the RF transmission line 103, and coupled to the RF transmission line.

The RF transmission line 103 illustratively includes a build section (not shown) extending from a surface of the subterranean formation 102 to a heel portion of the wellbore 255, and an electromagnetic choke assembly section 114 coupled to the build section. The electromagnetic choke assembly section 114 comprises a heel isolator 118 surrounding the RF transmission line 103. The RF electromagnetic choke assembly section 114 illustratively includes a plurality of tool centralizers 117*a*-117*e* coupled to the RE transmission line 103 and longitudinally spaced apart thereon. The RF transmission line 103 illustratively includes a guide string 113 at a distal end, and the RF antenna assembly 104 also comprises a plurality of tool centralizers 115*a*-115*f* longitudinally spaced apart on the guide string.

Figure 2:
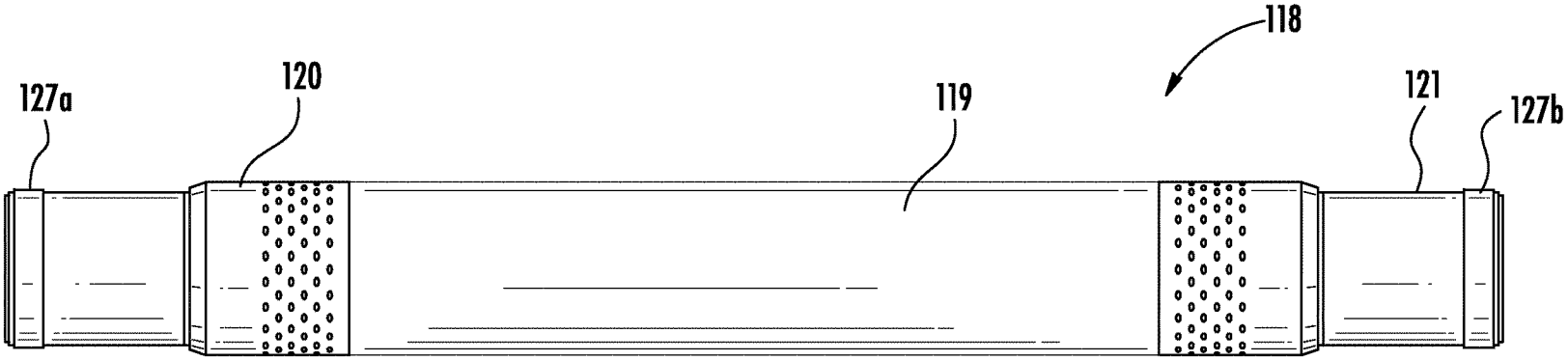
FIG. 2 is a side elevational view of a heel isolator from the hydrocarbon recovery system of FIG. 1.
Figure 3:
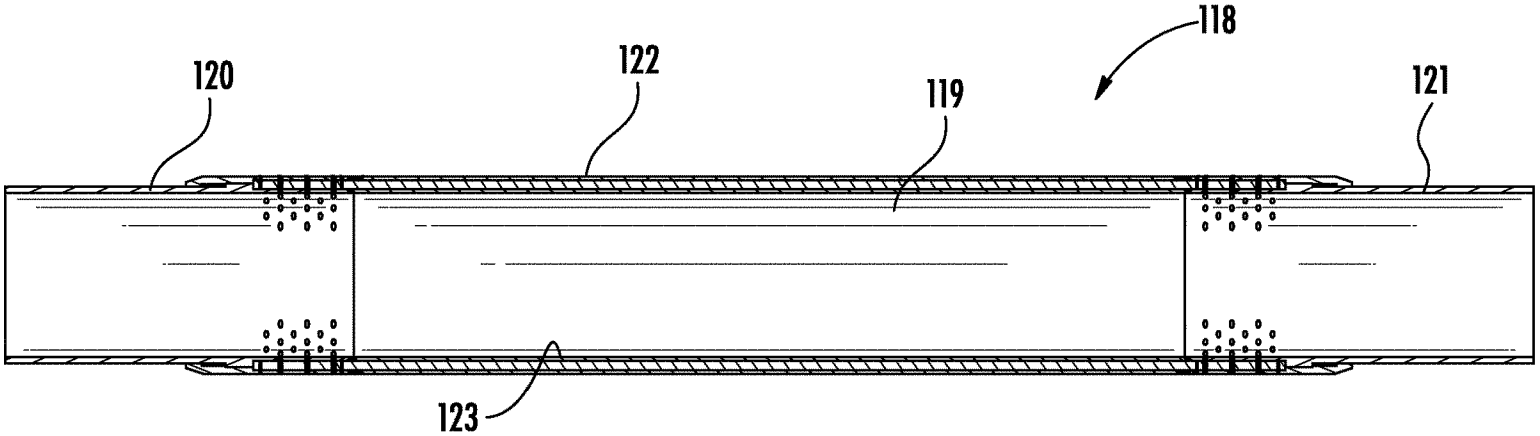
FIG. 3 is a cross-sectional view of the heel isolator from FIG. 2.
Figure 4:
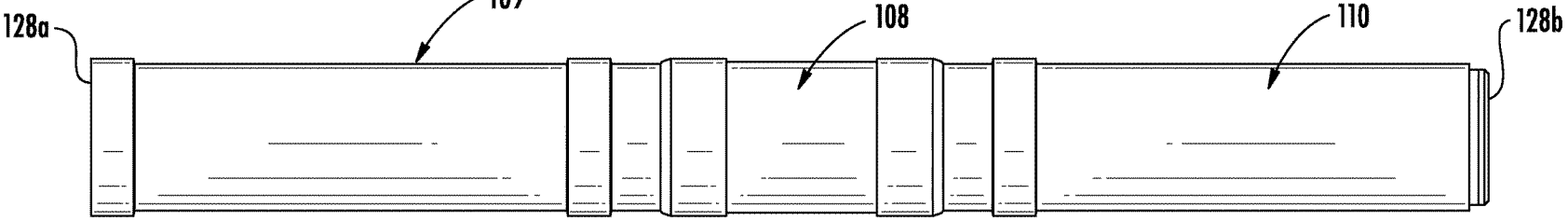
FIG. 4 is a side elevational view of an RF antenna assembly from the hydrocarbon recovery system of FIG. 1.
Figure 5:
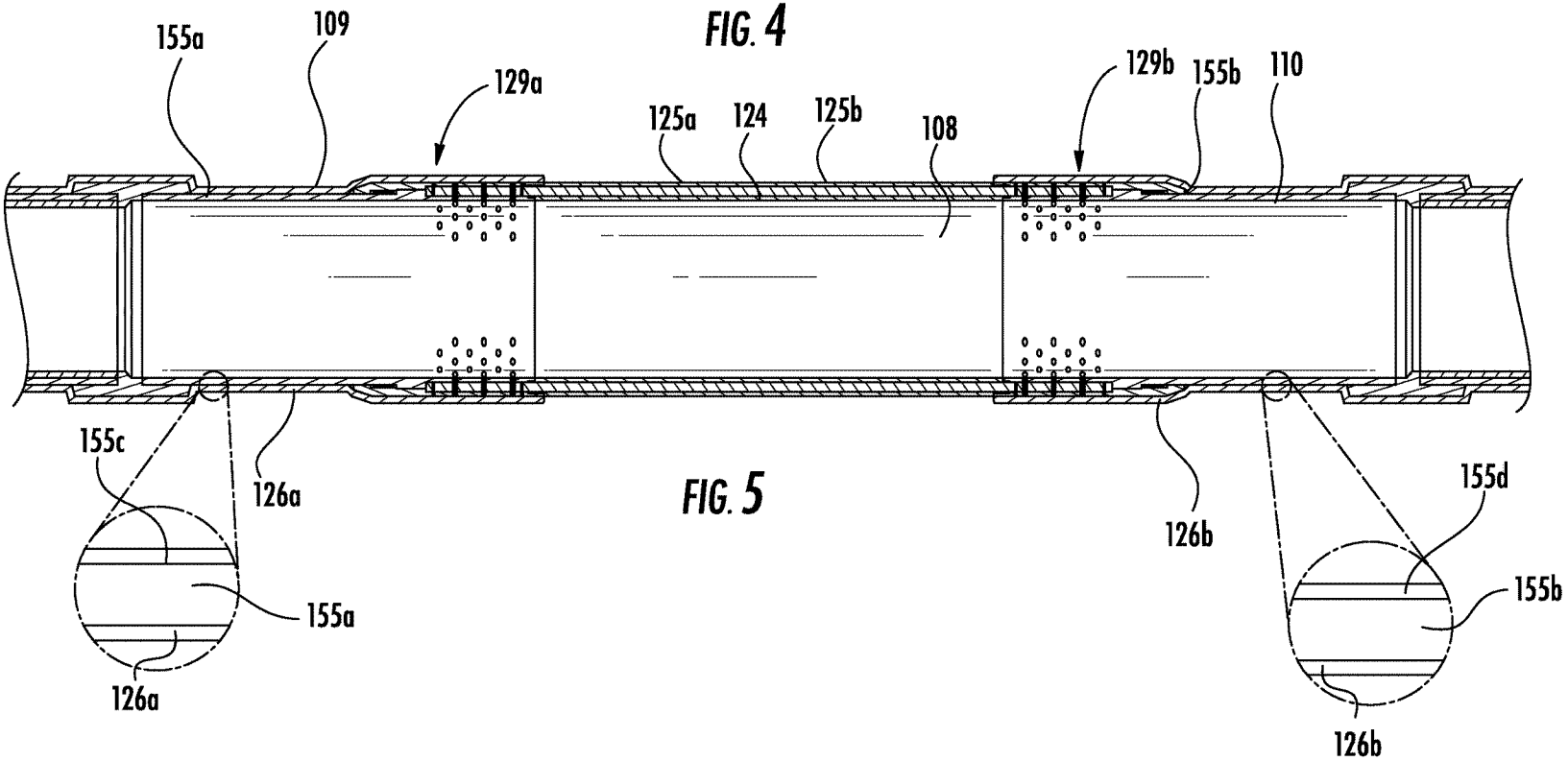
FIG. 5 is a cross-sectional view of the RF antenna assembly from FIG. 4.
Figure 6:
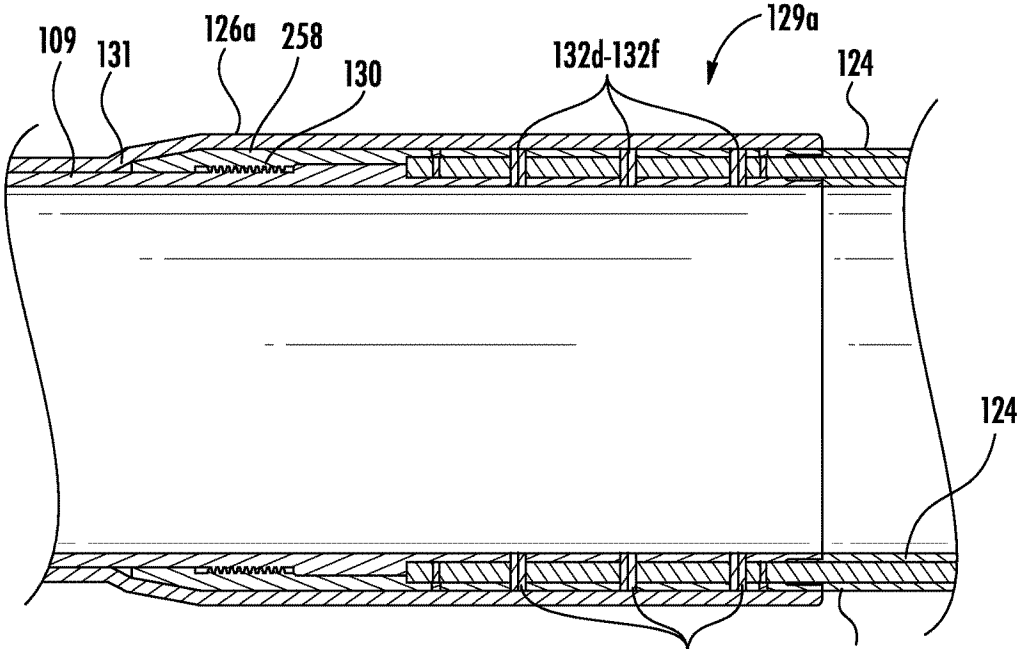
FIGS. 6 and 7 are cross-sectional views of portions of the RF antenna assembly from FIG. 4.
Figure 7:
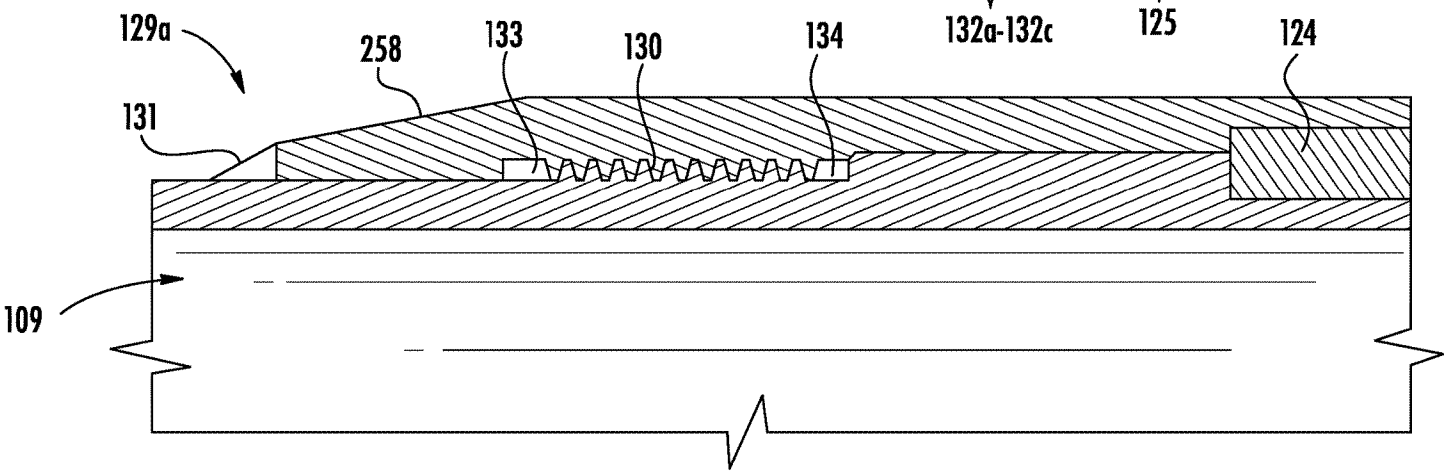

Referring now additionally to FIGS. 2-3, the heel isolator 118 illustratively includes first and second heel tubular connectors (e.g. comprising high strength steel) 120, 121, and a heel dielectric tube 119 therebetween. Each of the first and second heel tubular connectors 120, 121 illustratively includes threading 127*a*-127*b* for engaging adjacent parts of the hydrocarbon recovery system 100. The heel dielectric tube 119 illustratively includes a heel inner coating 123, and a heel outer coating 122, each heel coating comprising PTFE in some embodiments and being, for example, 0.10-0.250 inches thick. As illustrated, the RF transmission line 103 extends through the heel isolator 118. Advantageously, the heel isolator 118 reduces common mode current in the hydrocarbon recovery system 100.

Helpfully, in embodiments where the heel dielectric tube 119 comprises a composite material (e.g. cyanate ester), the heel outer and inner coatings 122, 123 provide chemical and mechanical abrasion protection from breakdown of the heel dielectric tube 119 during hydrocarbon resource production. In particular, the heel outer and inner coatings 122, 123 protect the heel dielectric tube 119 from the effects of hydrolysis (i.e. steam), corrosive gases/fluids, all fluids (e.g. hydrocarbon, oil, bitumen, seawater, water, etc.), and hydrogen sulfide.

The RF antenna assembly 104 (FIG. 1) illustratively includes a feed structure 135 coupled to a distal end of the RF transmission line 103. The feed structure 135 illustratively includes a first radially compressible connector 136 (FIG. 10) (i.e. the connector has radially outward spring action/force to maintain solid contact) coupled to the outer conductor 256 (FIG. 11) of the RF transmission line 103. The first radially compressible connector 136 is configured to slidably engage adjacent portions of the first electrical contact sleeve 109, thereby electrically coupling the outer conductor 256 to the first electrical contact sleeve.

Figure 10:
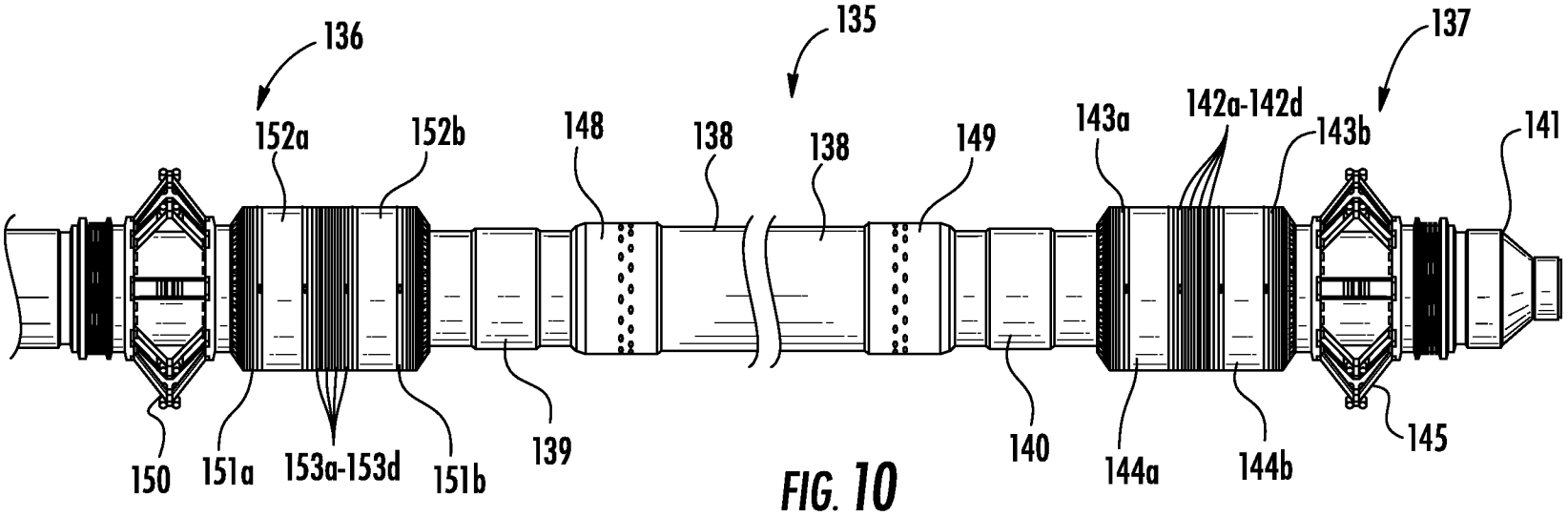
FIG. 10 is a side elevational view of the RF transmission line from the hydrocarbon recovery system of FIG. 1.

The feed structure 135 illustratively includes a second radially compressible connector 137 coupled to the inner conductor 257 of the RF transmission line 103. The second radially compressible connector 137 is configured to slidably engage adjacent portions of the second electrical contact sleeve 110, thereby electrically coupling the inner conductor 257 to the second electrical contact sleeve. The feed structure 135 illustratively includes a dielectric tube (e.g. cyanate ester) 138 coupled between the first and second radially compressible connectors 136, 137. (FIG. 10)

Additionally, the first electrical contact sleeve 109 illustratively includes a first outer sleeve 155*a* and a first inner electrically conductive liner 155*c* therein. The second electrical contact sleeve 110 illustratively includes a second outer sleeve 155*b* and a second inner electrically conductive liner 155*d* therein. In some embodiments, the first and second inner electrically conductive liners 155*c*-155*d* may each comprise stainless steel for corrosion resistance with sufficient electrical conductivity.

In the illustrated embodiment, the first and second tubular conductors 106, 107, the dielectric isolator 108, the first and second electrical contact sleeves 109, 110 are all part of the well casing, i.e. these components directly contact adjacent portions of the subterranean formation 102. As discussed herein, this reduces the complexity of the installation of the hydrocarbon recovery system 100 within the subterranean formation 102.

Referring now additionally to FIGS. 4-7, the first and second electrical contact sleeves 109, 110 each comprises a threaded end 128*a*-128*b* for engaging the adjacent first and second tubular conductors 106, 107. The RF antenna assembly 104 illustratively includes an insulating coating 126*a*-126*b* on the first and second electrical contact sleeves 109, 110 and at least a portion of the first and second tubular conductors 106, 107. For example, the insulating coating 126*a*-126*b* may comprise PTFE.

The dielectric isolator 108 may comprise a tubular dielectric member (e.g. cyanate ester) 124, an outer coating (e.g. PTFE) 125*a* on the tubular dielectric member, and an inner coating (e.g. PTFE) 125*b* on the tubular dielectric member. The outer and inner coatings 125*a*, 125*b* may be, for example, 0.10-0.250 inches thick. The tubular dielectric member 124 may comprise cyanate ester, for example. In some embodiments, the tubular dielectric member 124 and the heel dielectric tube 119 may each comprise longitudinally spaced outer diameter abrasion rings. These outer diameter abrasion rings are portions of the tubular dielectric member 124 and the heel dielectric tube 119 that have increased thickness, for example, 0.100 inches thicker, and provide enhanced mechanical strength.

The dielectric isolator 108 illustratively includes opposing ends 129*a*-129*b* fitted onto respective ends of the tubular dielectric member 124. As perhaps best seen in FIGS. 6-7, each opposing end 129*a*-129*b* illustratively includes a tubular connector (e.g. comprising high strength steel) 258 cooperating with adjacent portions of the first electrical contact sleeve 109 for defining a tubular recess configured to receive the respective end of the tubular dielectric member 124. The tubular connector 258 and the first electrical contact sleeve 109 are coupled together via a threaded interface 130 and an annular weld 131, which prevents clocking of adjacent fittings due to torsional loads. The threaded interface 130 defines opposing recesses 133, 134. Also, each opposing end 129*a*-129*b* illustratively includes a plurality of pins 132*a*-132*f* (e.g. 6 rows of 20 pins with 0.375 inch diameter, match drilled, and with axial passageway for adhesive material injection to avoid pressure lock) extending through the tubular connector 258, the tubular dielectric member 124, and adjacent portions of the first electrical contact sleeve 109 for providing enhanced mechanical strength. Each pin 132*a*-132*f* may comprise aluminum, for example.

Figure 8:
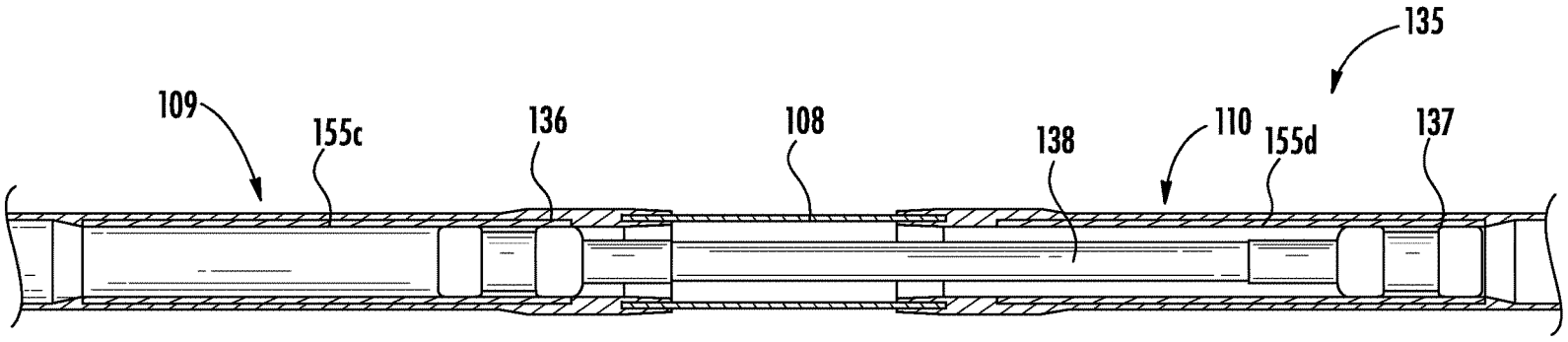
FIG. 8 is a cross-sectional schematic view of the RF antenna assembly from FIG. 4 with the RF transmission line therein.
Figure 9:
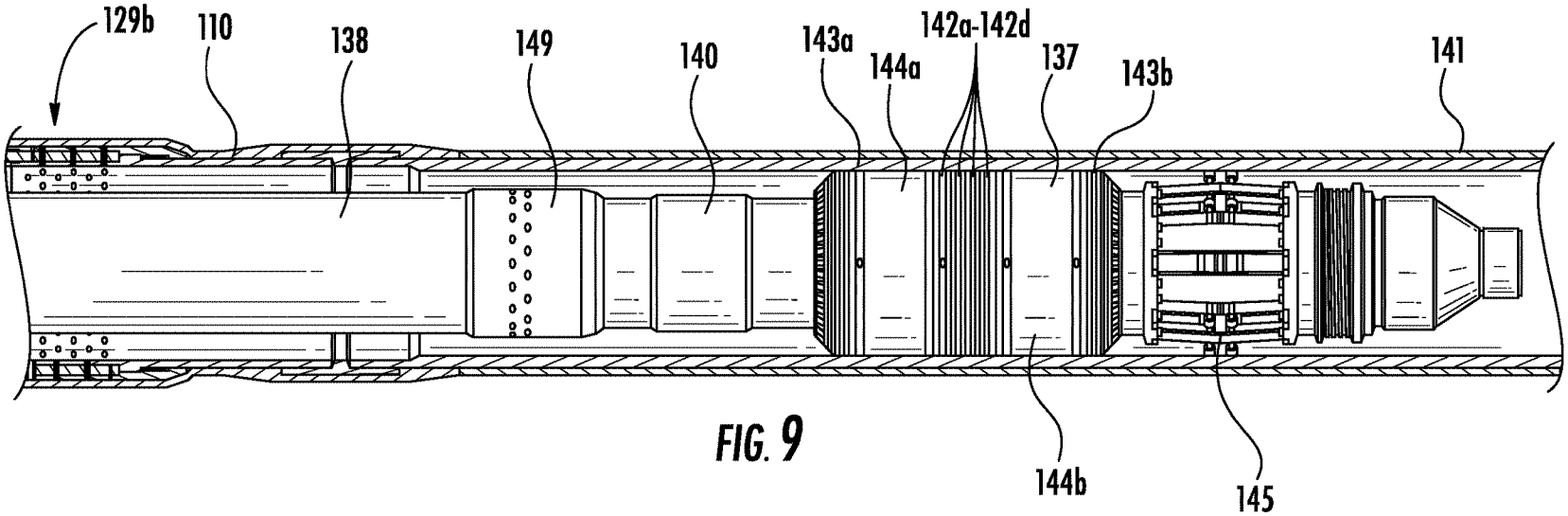
FIG. 9 is a partial cross-sectional view of the RF antenna assembly from FIG. 4 with the RF transmission line therein.

Referring now additionally to FIGS. 8-10, the feed structure 135 is able to extend longitudinally within the RF antenna assembly 104 while maintaining electrical contact via the first and second electrical contact sleeves 109, 110. This is enabled by the first and second radially compressible connectors 136, 137 slidably engaging adjacent portions of the first and second electrical contact sleeves 109, 110. During normal operation of the hydrocarbon recovery system 100, the temperature can vary, causing thermal expansion/contraction of the RF antenna assembly 104 within the wellbore 255. In typical approaches, the assembly components are carefully designed to mitigate thermal expansion issues. For example, in the approach of U.S. Pat. No. 9,376,897 to Ayers et al., also assigned to the present application's Assignee, the entire RF assembly, i.e. the RF transmission line and dipole antenna, is assembled aboveground and would be inserted into the wellbore 255, i.e. the well casing is assembled and formed in an entirely separate process.

Advantageously, in the disclosed RF antenna assembly 104, the dipole antenna is assembled in-situ and part of the well casing. The RF transmission line 103 is assembled above ground and pushed downward into the wellbore 255. Accordingly, there needs to be some longitudinal give built into the design to maintain a continuous electrical coupling with the dipole antenna elements, i.e. the first and second electrical contact sleeves 109, 110, as the wellbore 255 increases in temperature, causing the RF transmission line 103 to elongate.

A consequence of this design, the dipole antenna elements, i.e. the first and second tubular conductors 106, 107, the first and second electrical contact sleeves 109, 110, and the dielectric isolator 108, will remain in the wellbore 255 for the life of the well. Positively, the insulating coating 126*a*-126*b* will provide chemical and mechanical abrasion (mainly during installation) protection for the RF antenna assembly 104 while is sits in the wellbore 255. Another facet of the RF antenna assembly 104 is that the first and second tubular conductors 106, 107, the first and second electrical contact sleeves 109, 110, and the dielectric isolator 108 include mechanical strength to support the structural loads during installation and operation.

The first radially compressible connector 136 illustratively includes a plurality of first watchband springs 153*a*-153*d*, which are electrically coupled to the outer conductor 256 of the RF transmission line 103. (See FIG. 10). In the illustrated embodiment, the RF antenna assembly 104 illustratively includes a plurality of first seals (e.g. swellable seals) 152*a*-152*b* associated with the plurality of first watchband springs 153*a*-153*d*, a plurality of first wipers 151*a*-151*b* associated with the plurality of first watchband springs, and a first spring loaded spacer 150 associated with the first radially compressible connector 136. Advantageously, due to the first wipers 151*a*-151*b*, first seals 152*a*-152*b*, and first watchband springs 153*a*-153*d*, the first radially compressible connector 136 maintains solid and clean mechanical contact with the first inner electrically conductive liner 155*c*, which is critical during hydrocarbon recovery.

The second radially compressible connector 137 illustratively includes a plurality of second watchband springs 142*a*-142*d*, which are electrically coupled to the inner conductor 257 of the RF transmission line 103. In the illustrated embodiment, the RF antenna assembly 104 illustratively includes a plurality of second seals (e.g. swellable seals) 144*a*-144*b* associated with the plurality of second watchband springs 142*a*-142*d*, a plurality of second wipers 143*a*-143*b* associated with the plurality of second watchband springs, and a second spring loaded spacer 145 associated with the second radially compressible connector 137. Advantageously, due to the second wipers 143*a*-143*b*, second seals 144*a*-144*b*, and second watchband springs 142*a*-142*d*, the second radially compressible connector 137 maintains solid and clean mechanical contact with the second inner electrically conductive liner 155*d*.

As perhaps best seen in FIG. 10, the RF transmission line 103 illustratively includes a bull nose cap 141, which is mechanically coupled to the second spring loaded spacer 145 via a threaded interface (not shown). The feed structure 135 illustratively includes first and second tubular connectors 148, 149 coupled to opposing ends of the dielectric tube 138. The first and second tubular connectors 148, 149 are then coupled respectively to the first and second radially compressible connectors 136, 137 via threaded rings 139, 140.

Referring now additionally to FIGS. 11-14, the RF antenna assembly 104 illustratively includes first and second threaded rings 154*a*-154*b* respectively coupling the opposing ends 129*a*-129*b* of the dielectric isolator 108 to the first and second electrical contact sleeves 109, 110. As best seen in FIGS. 1 and 11-14, the RF transmission line 103 is longitudinally extended within the RF antenna assembly 104.

Advantageously, the disclosed RF antenna assembly 104 is of appropriate dimensions to structurally support the radiating elements of the in-situ dipole antenna, and the dielectric isolator 108 of a length providing adequate standoff distance to ensure no arcing between the polarized components over a wide range of environmental conditions. The disclosed RF antenna assembly 104 comprises materials of sufficient electrical properties to provide minimal absorption of radiated energy, and with retention of structural integrity. Moreover, the disclosed RF antenna assembly 104 provides electrical segregation of component parts over long duration at environmental extremes, and includes dielectric tubes with quartz/S-Glass reinforced cyanate ester in a thick walled form, length, as required for performance plus margin. The disclosed RF antenna assembly 104 uses end-fittings with rounded features, blind-pinned, and bonded to prevent arcing from field concentration at sharp edges, and the disclosed RF antenna assembly is sealed for fluid and gas pressure.

As noted above, the RF antenna assembly 104 must withstand the rigors of the wellbore 255 for the life of the well. The operational parameters are, for example: maximum temperature T=300° C. (572° F.); maximum external pressure DP=870 psi×1.0 $ft^2$; maximum overburden pressure at 500 meter depth DP=6,000 kPa (870 psi) associated with formation collapse, based on 12 kPa/meter gradient; and maximum axial force that can develop prior to deployment of thermal compensator: 50 kpsi.

Referring now to FIGS. 15A-22B, a method for making the dielectric isolator 108 from the RF antenna assembly 104 is now described. This process is exemplary, and other methods for making the dielectric isolator 108 are envisioned. In a first step, the inner PTFE sleeve 157 is installed onto a manufacturing mandrel using a tooling nose cone bolted to the manufacturing mandrel. In a second step, the pre-preg (TC420/6781 S-Glass, as available from Koninklijke Ten Cate NV of Nijverdal, Netherlands) tube 156 is rolled over the inner PTFE sleeve 157 with knitted E-glass backing (0.160 inches thick). The mandrel is cured at 350° F. and post cured at 480° F. according to a manufacturer recommended cure cycle.

Figure 15A:
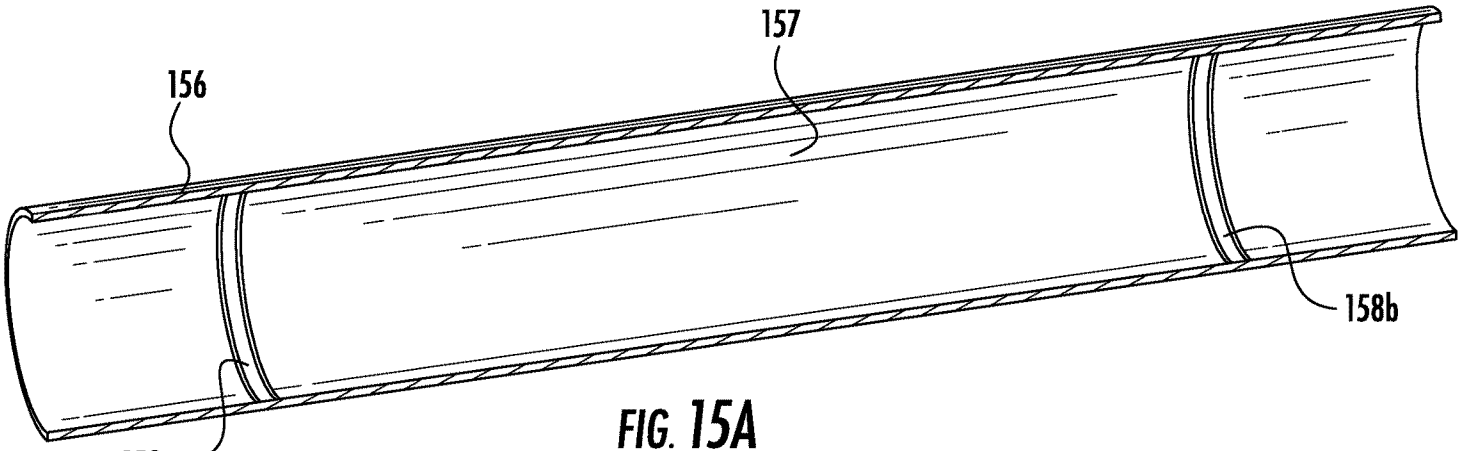
FIGS. 15A-22B are cross-sectional and side elevational views of steps in a method for making the dielectric isolator from the RF antenna assembly of FIG. 4, according to an example embodiment.
Figure 15B:
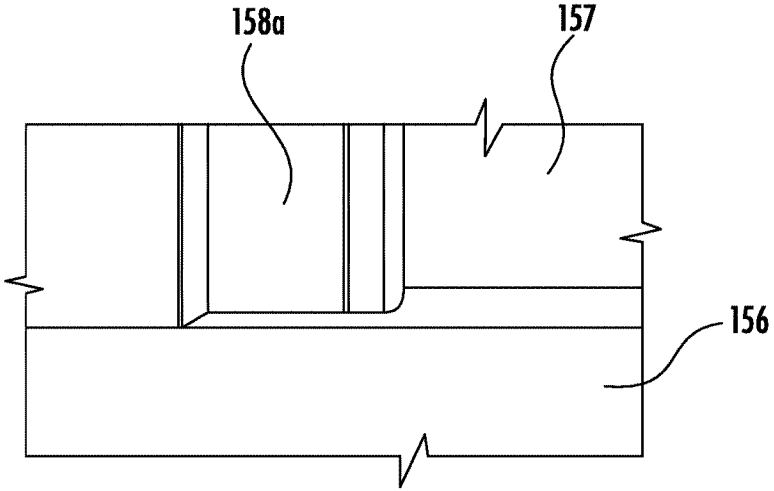
Figure 16:
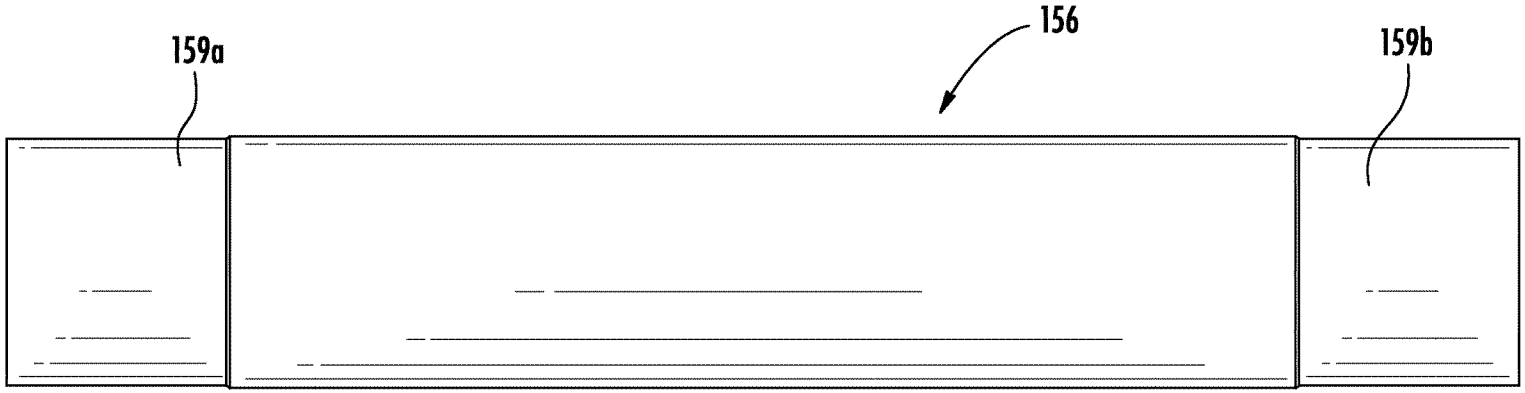
Figure 17A:
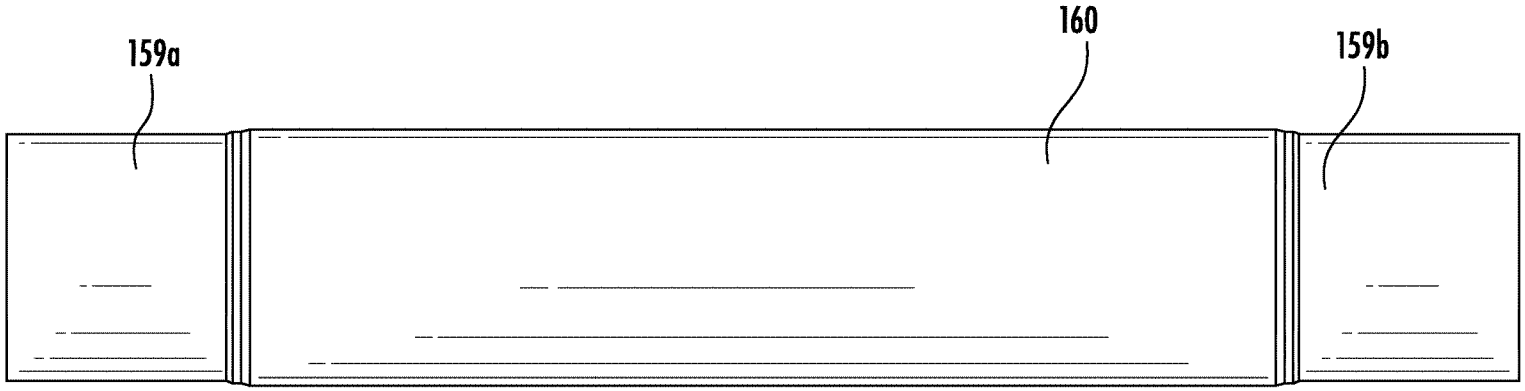
Figure 17B:
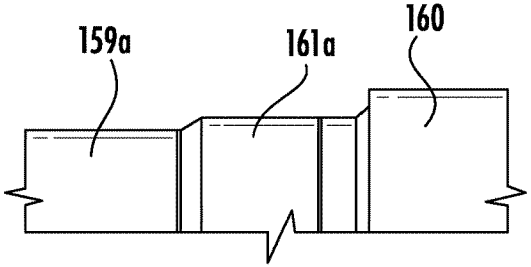

In FIG. 15A, the tube 156 is cut to length, and the tube internal diameter is measured. The inner PTFE sleeve 157 is machined, and the tube internal diameter is precision ground at each end to define multi-diameter shoulders 158*a*-158*b*. In FIG. 16, the outer diameter of the tube 156 is measured to determine its deviation from nominal, and a precision grind step is performed to reduce the outer diameter for at a portion 159*a*-159*b* of the tube at opposing ends. In FIG. 17B, the outer PTFE sleeve 160 is installed on the tube 156 using a transfer tooling mandrel and then post-machining the outer PTFE sleeve at each end of the tube to have a multi-diameter shoulder 161*a*-161*b*.

Figure 18:
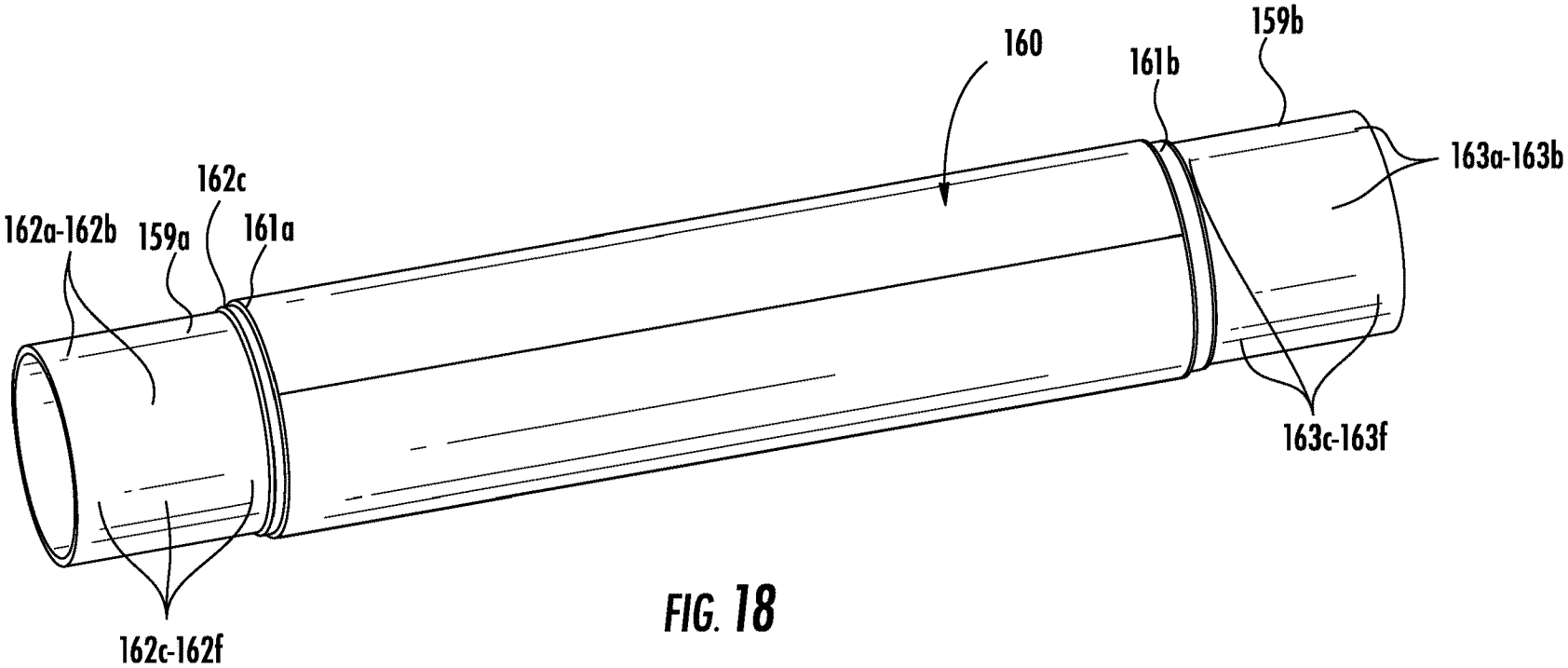
Figure 19A:
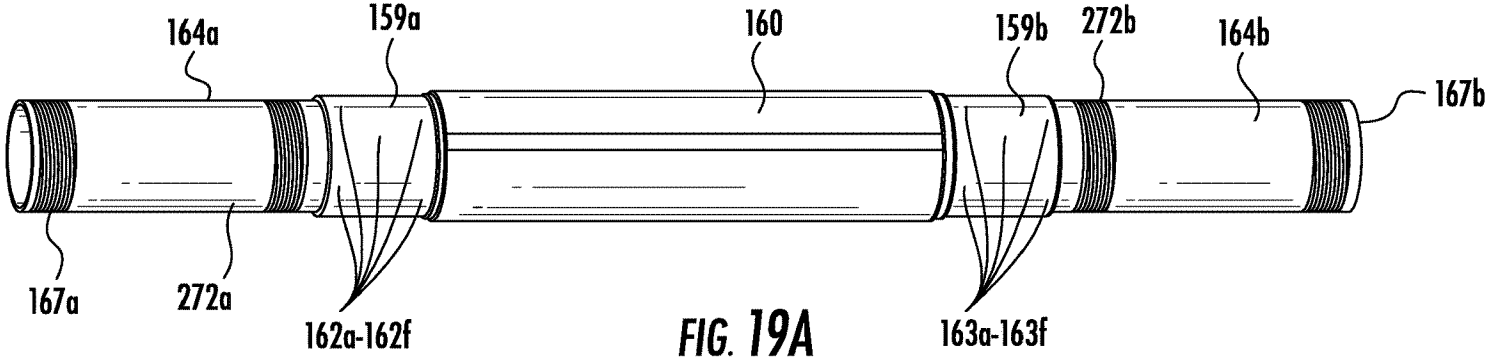
Figure 19B:
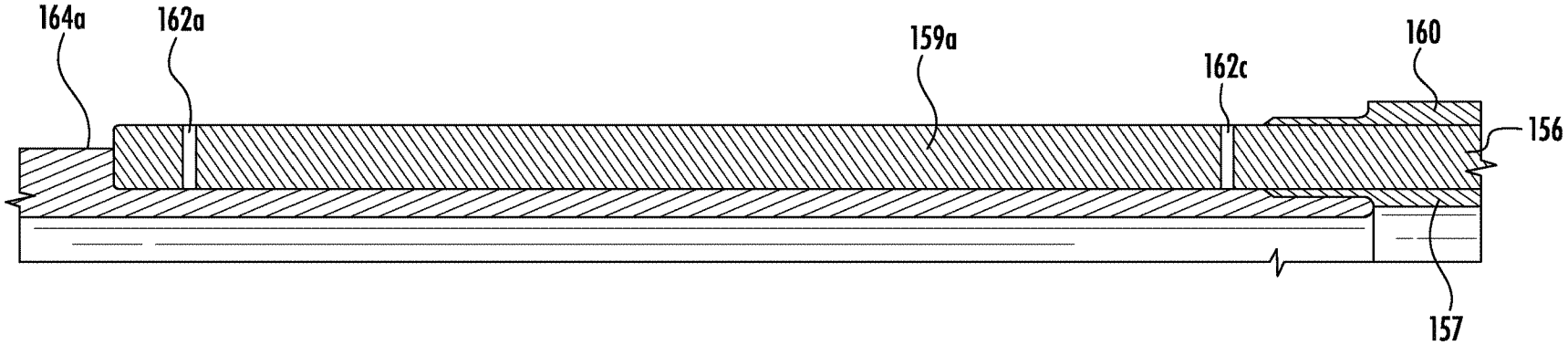
Figure 20A:
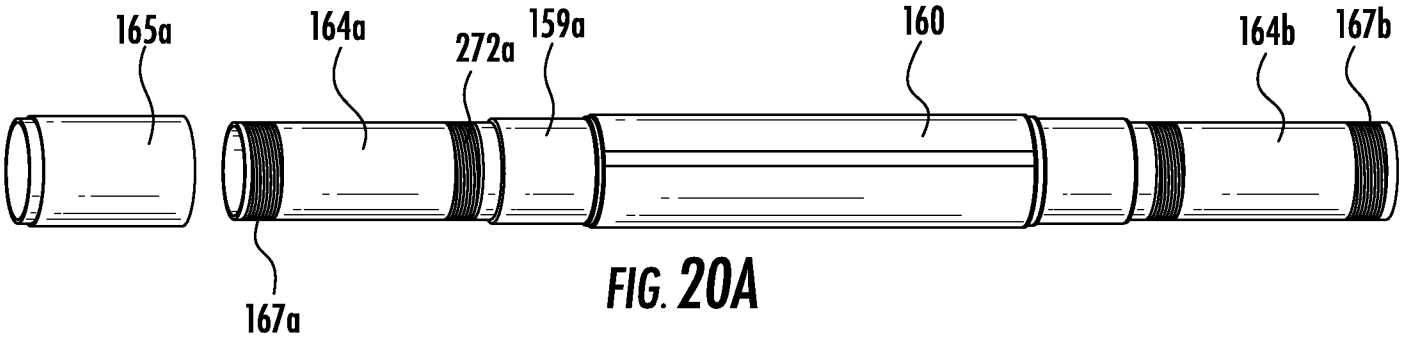
Figure 20B:
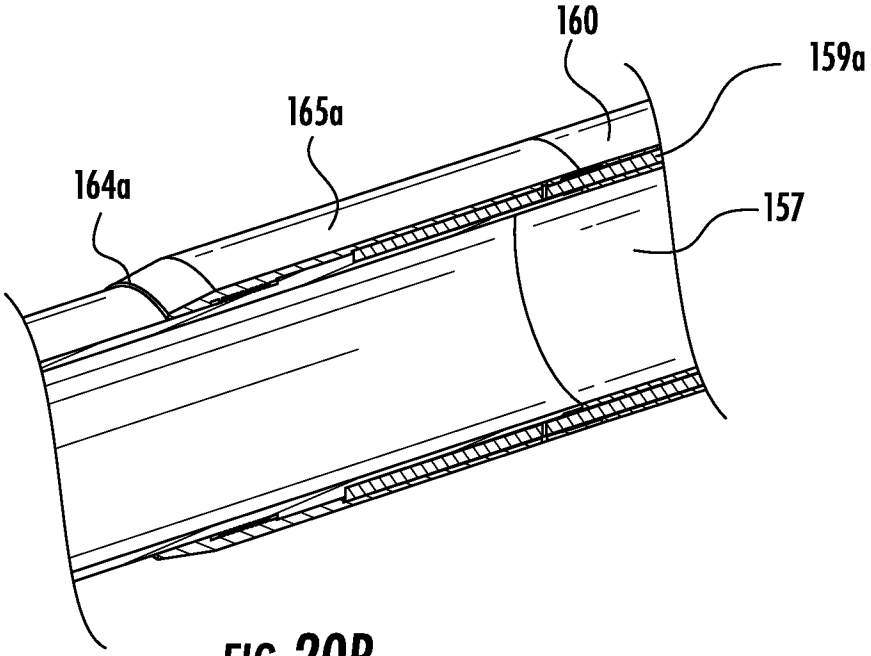
Figure 21A:
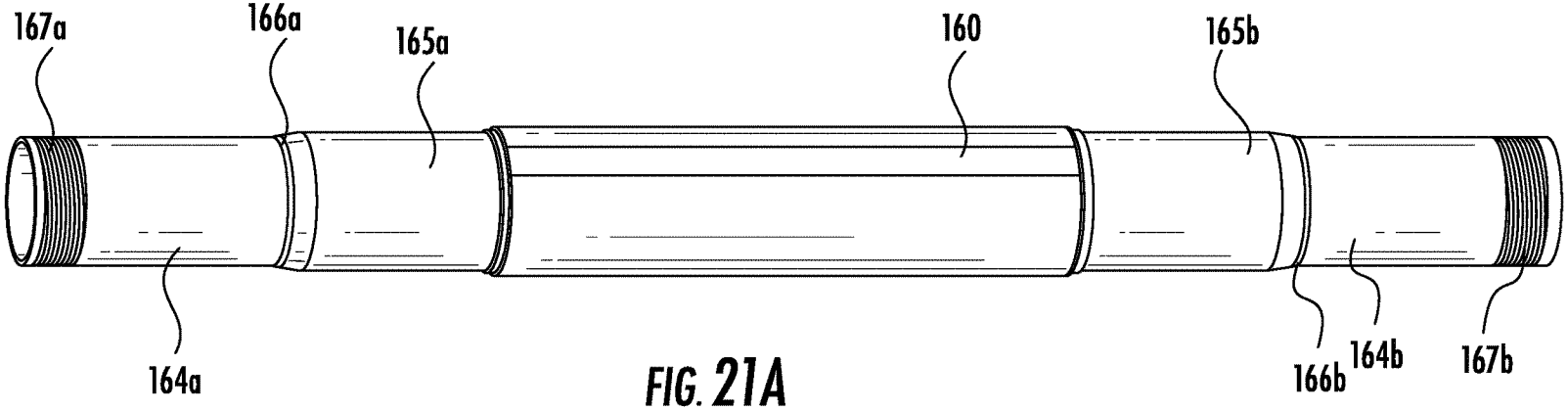
Figure 21B:
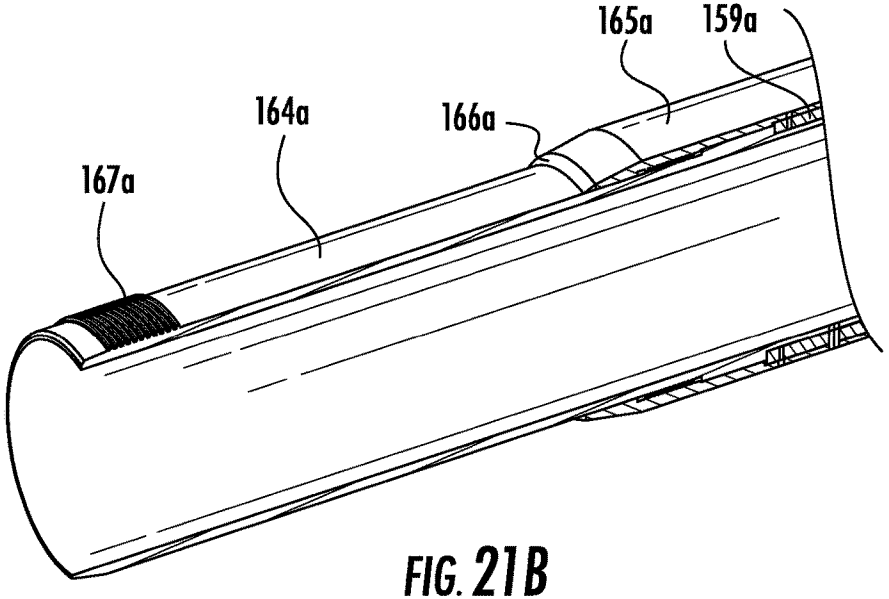
Figure 22A:
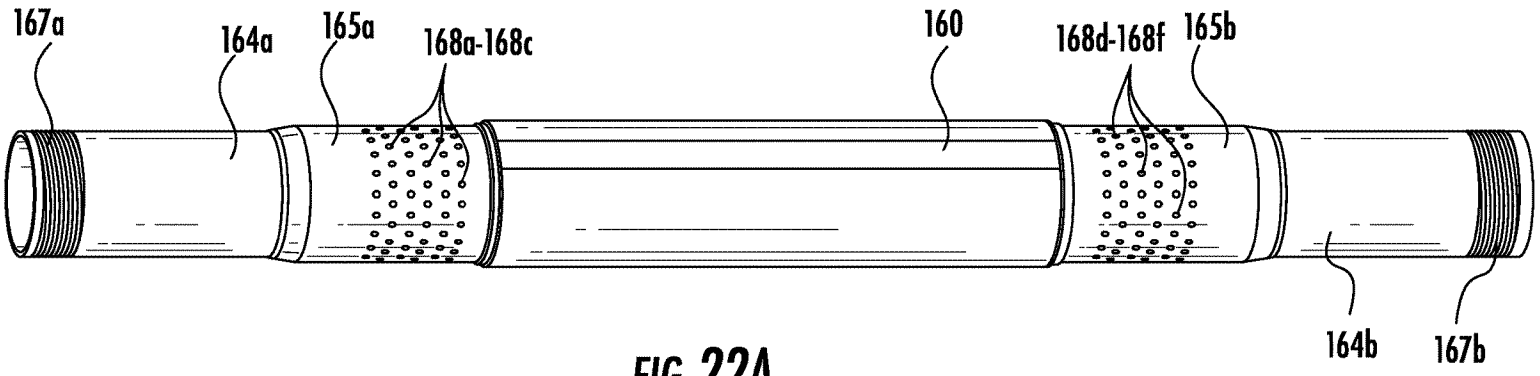
Figure 22B:
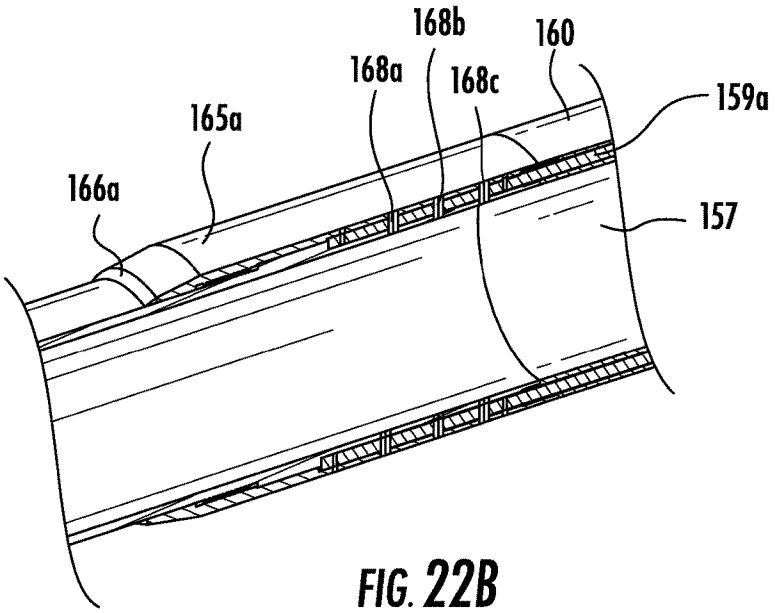

In FIG. 18, three rows of injections passageways 162*a*-162*f*, 163*a*-163*f* are drilled on each end of the tube 156. In FIGS. 19A-19B, the tube 156 is injection bonded to inner fittings 164*a*-164*b*, each internal fitting having a distal threading 167*a*-167*b* and a proximal threading 272*a*-272*b*. The injection bonding process uses an adhesive resin at −75° C. Here, only a single 350° F. cure is required. In FIGS. 20A-20B, the outer sleeves 165*a*-165*b* are threaded onto the proximal threadings 272*a*-272*b* of the internal fittings 164*a*-164*b*. Here, adhesive resin is filled in the drilled openings, and another curing process is performed. In FIGS. 21A-21B, the outer sleeves 165*a*-165*b* are welded onto the internal fittings 164*a*-164*b* via an annular weld 166*a*-166*b*. In FIGS. 22A-22B, passageways 168*a*-168*f* are drilled in the outer sleeves 165*a*-165*b*, and pins are inserted in the passageways along with an adhesive resin. Another curing process is performed.

Figure 23:
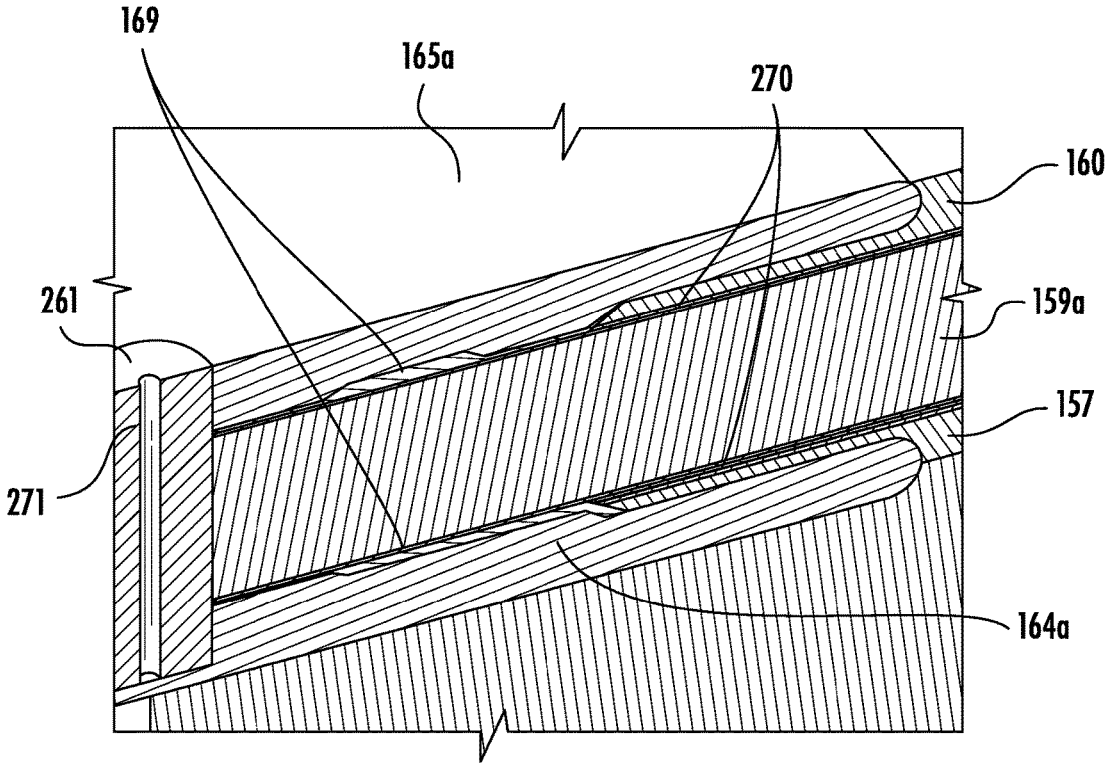
FIG. 23 is a partial cross-sectional view of the RF antenna assembly from FIG. 4.
Figure 24B:
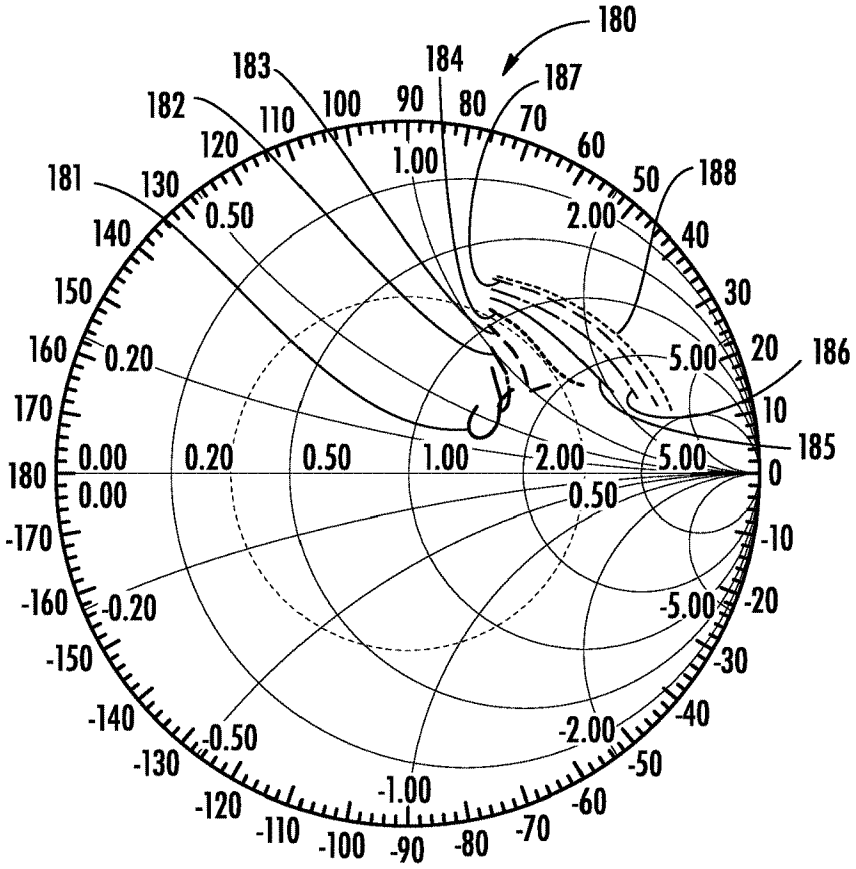
FIGS. 24A-25E are Smith charts for the RF antenna assembly from FIG. 4.
Figure 24A:
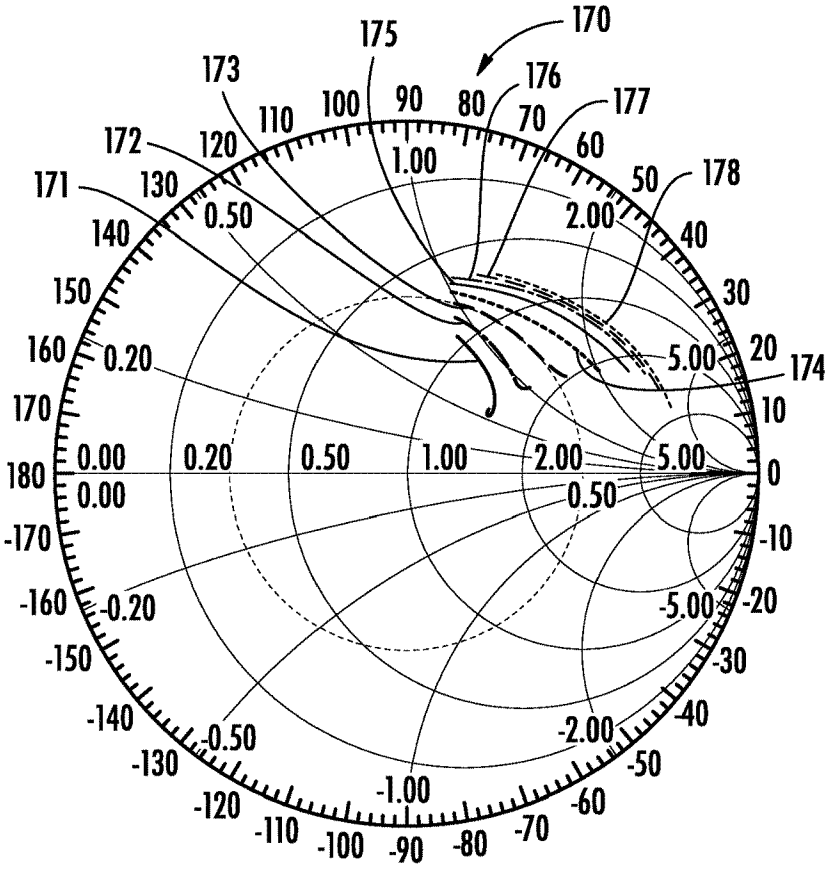
Figure 24D:
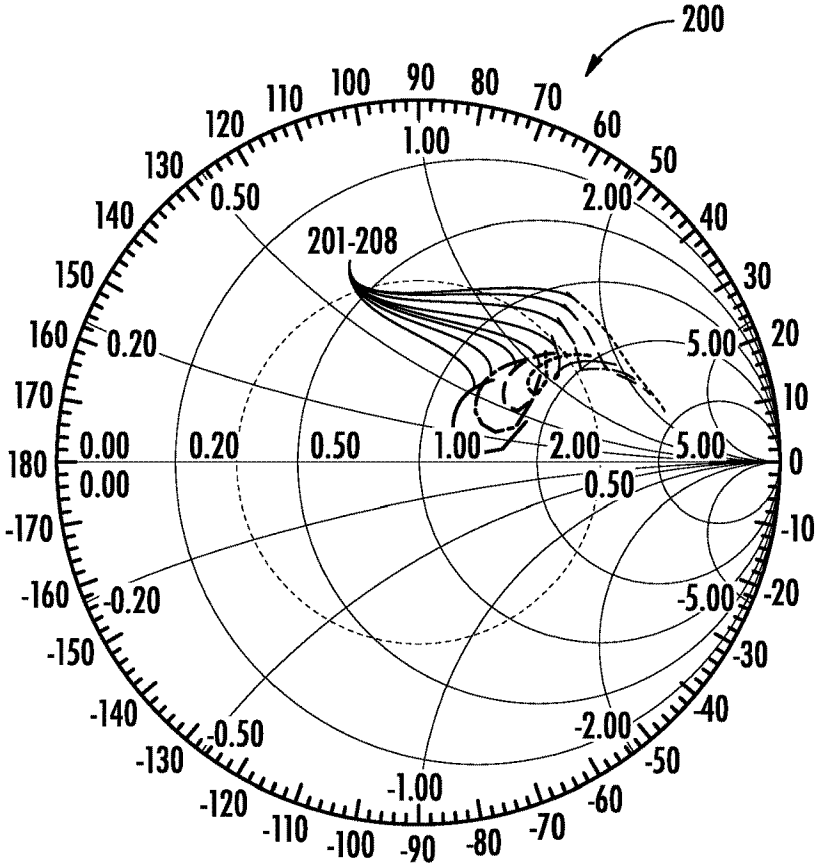
Figure 24C:
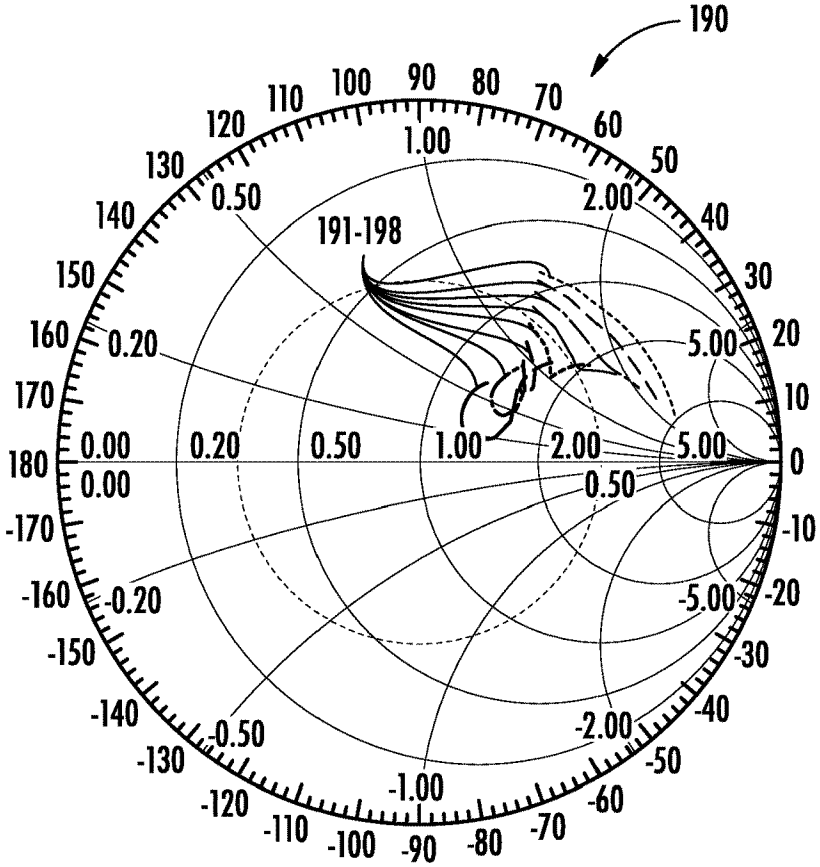
Figure 24F:
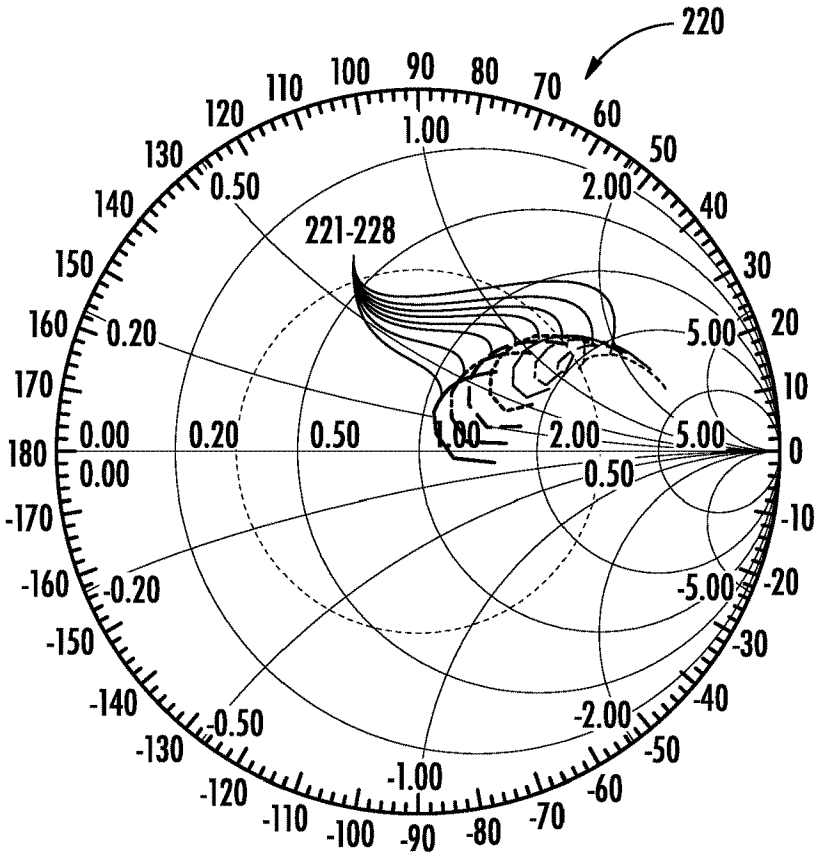
Figure 24E:
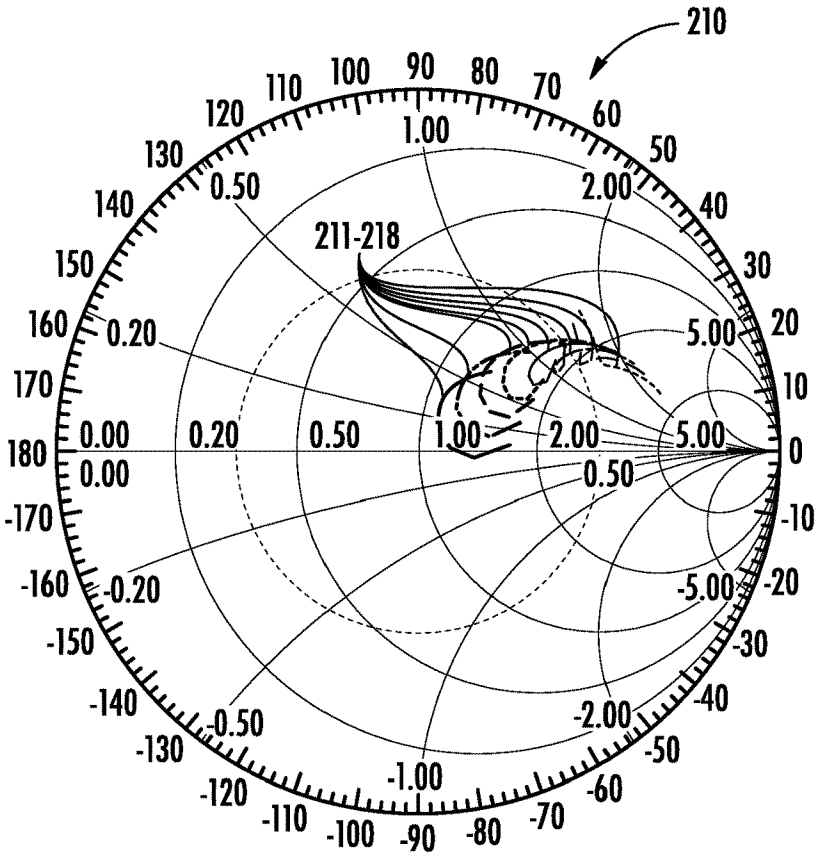
Figure 25A:
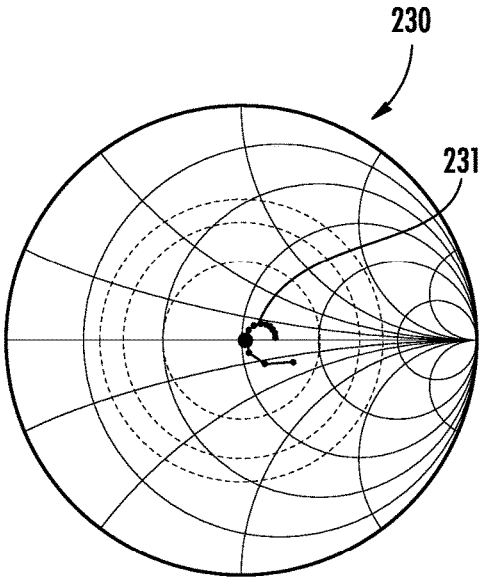
Figure 25B:
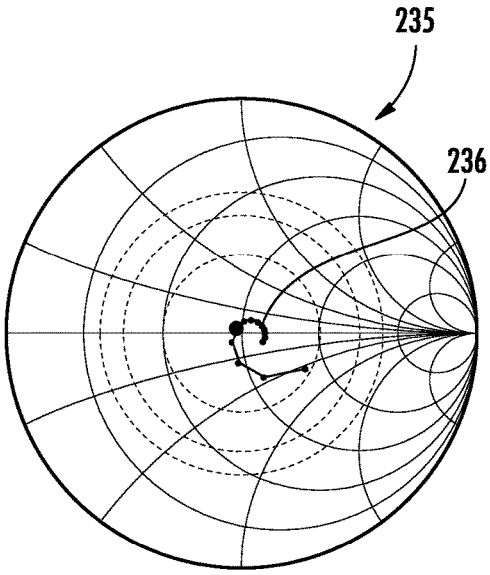
Figure 25C:
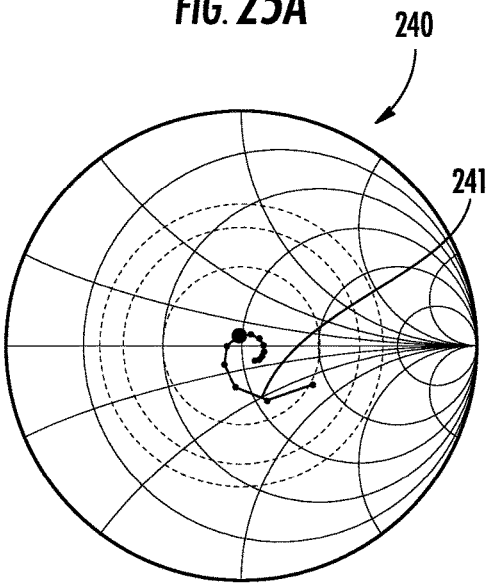
Figure 25D:
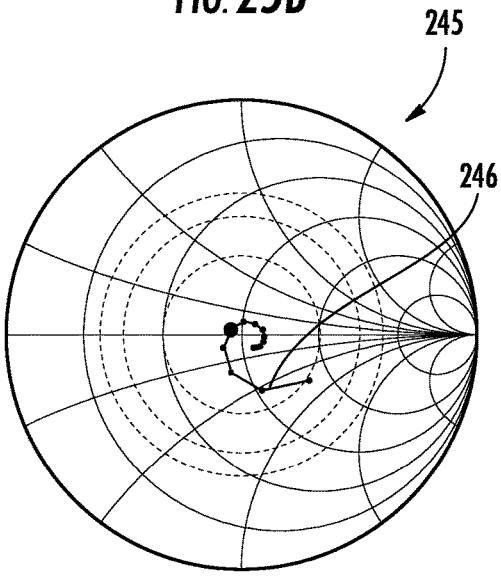
Figure 25E:
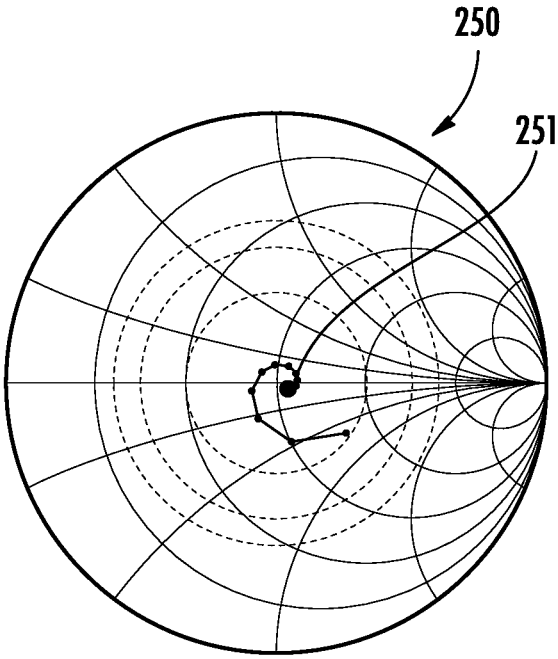

Referring now to FIG. 23, a joint within the dielectric isolator 108 is described. In particular, the joint is the coupling of the outer sleeve 165*a* and the internal fitting 164*a* around the portion 159*a* of the tube 156. The joint illustratively includes adhesive resin 169 on internal and external surfaces of the tube 156, and surface piles of woven laminate 270 on the surfaces of the tube. Also, the joint illustratively includes a pin 261 within a respective passageway 168*a*-168*f*. The pin 261 illustratively includes an axial passageway 271 configured to receive adhesive material.

Yet another aspect is directed to a method for making an RF antenna assembly 104 positioned within a wellbore 255 in a subterranean formation 102 for hydrocarbon resource recovery. The method may include positioning first and second tubular conductors 106, 107, first and second electrical contact sleeves 109, 110, and a dielectric isolator 108 in the wellbore 255 and so that the first and second electrical contact sleeves are respectively coupled between the first and second tubular conductors and the dielectric isolator. The first and second tubular conductors 106, 107 define a dipole antenna. The method may include coupling a feed structure 135 to a distal end of an RF transmission line 103, the RF transmission line comprising an inner conductor 257 and an outer conductor 256. The feed structure 135 may include a first radially compressible connector 136 coupled to the outer conductor 256 of the RF transmission line 103 to slidably engage adjacent portions of the first electrical contact sleeve 109, a second radially compressible connector 137 coupled to the inner conductor 257 of the RF transmission line to slidably engage adjacent portions of the second electrical contact sleeve 110, and a dielectric tube 138 coupled between the first and second radially compressible connectors. The method includes positioning the RF transmission line 103 within the wellbore 255 and extending within the first tubular conductor 106.

In particular, the method may include the first steps of drilling the vertical portion of the wellbore 255 and installing the associated well casing. The method includes drilling the horizontal portion of the wellbore 255, and installing the horizontal well casing, i.e. the first and second tubular conductors 106, 107, the first and second electrical contact sleeves 109, 110, and the dielectric isolator 108. The method includes a heavy reverse circulation step to remove debris from the build section. Afterwards, the drilling rig is removed, and the method includes installing a tubing hangar and wellhead cap at the surface. The method includes installing the RF transmission line 103 segment-by-segment, starting with feed structure 135.

Referring again to FIG. 5, as noted above, the first and second tubular conductors 106, 107, the dielectric isolator 108, and the first and second electrical contact sleeves 109, 110 define a dipole antenna powered by an RF signal from the RF source 101, transmitted down the wellbore 255 by the RF transmission line 103. In some embodiments, the first and second tubular conductors 106, 107, the dielectric isolator 108, the first and second electrical contact sleeves 109, 110 are all part of the well casing. Since the wellbore 255 can be a damp environment, in typical approaches, the dipole antenna would be shorted, having a near zero effective length. Hence, the dipole antenna would have a length much smaller than the wavelength of the signal, thereby causing the dipole antenna to have a low radiation resistance (and a high capacitive reactance), making it an inefficient antenna. This inefficiency would drive up sensitive hydrocarbon recovery costs.

Accordingly, in typical approaches, the RF source 101 would comprise multiple RF transmitters, such as a first initial high frequency start-up RF transmitter and a second sustaining RF transmitter (having a different lower operational frequency and power consumption). The first transmitter would desiccate the adjacent portions of the wellbore 255, and the second transmitter (e.g. lower frequency transmitter) would be subsequently coupled to the RF transmission line 103. In a typical hydrocarbon recovery operation, efficiency is critical. This is due to the costly nature of powering RF transmitters in hydrocarbon recovery.

Advantageously, in the disclosed embodiments, the RF antenna assembly 104 has the insulating coating 126*a*-126*b* on the first and second electrical contact sleeves 109, 110 and at least a portion of the first and second tubular conductors 106, 107. In other words, the dipole antenna has a minimum starting antenna length, and a single RF transmitter can be used, i.e. the first RF transmitter can be eliminated. Since the first RF transmitter is not needed, capital expenditures are reduced. Moreover, these RF transmitters are large and ungainly, making them expensive to swap out. Yet further, the insulating coating 126*a*-126*b* helpfully provides for impedance control for the dipole antenna, and improves dielectric breakdown levels.

Referring now additionally to FIGS. 24A-25E, several Smith charts 170, 180, 190, 200, 210, 220, 230, 235, 240, 245, 250 for the RF antenna assembly 104 are now described. In these charts, parametric sweeps were performed with the following values: nominal reservoir conductivity $\sigma$=0.003 S/m, antenna length=800 m, frequency range 200-800 kHz, sweep ½" Teflon coating from 30 to 80 m, and sweep 1 meter radius desiccation cylinder from 5 to 40 meters. In chart 170, the insulating coating 126*a*-126*b* is ½ inch thick and 30 m in length. The desiccation cylinder has a 1 m radius, and a variable length in meters of 5, 10, 15, 20, 25, 30, 35, and 40, respectively, with curves 171-178.

In chart 180, the insulating coating 126*a*-126*b* is inch thick and 40 m in length. The desiccation cylinder has a 1 m radius, and a variable length in meters of 5, 10, 15, 20, 25, 30, 35, and 40, respectively, with curves 181-188. In chart 190, the insulating coating 126*a*-126*b* is ½ inch thick and 50 meters in length. The desiccation cylinder has a 1 m radius, and a variable length in meters of 5, 10, 15, 20, 25, 30, 35, and 40, respectively, with curves 191-198.

In chart 200, the insulating coating 126*a*-126*b* is inch thick and 60 meters in length. The desiccation cylinder has a 1 m radius, and a variable length in meters of 5, 10, 15, 20, 25, 30, 35, and 40, respectively, with curves 201-208. In chart 210, the insulating coating 126*a*-126*b* is ½ inch thick and 70 meters in length. The desiccation cylinder has a 1 m radius, and a variable length in meters of 5, 10, 15, 20, 25, 30, 35, and 40, respectively, with curves 211-218. In chart 220, the insulating coating 126*a*-126*b* is ½ inch thick and 80 meters in length. The desiccation cylinder has a 1 m radius, and a variable length in meters of 5, 10, 15, 20, 25, 30, 35, and 40, respectively, with curves 221-228.

In charts 230, 235, 240, 245, 250, parametric sweeps were performed with the following values: sweep ½ inch Teflon coating with 80 m length, transmitter power 1 kW/m (800 kW), sweep 0.2 to 0.8 MHz, 0.05 MHz step, and duration of 20 days, 1 day step. Curves 231, 236, 241, 246, and 251 represent performance at start-up, 1 day, 2 days, 3 days, and 4 days, respectively.

Other features relating to hydrocarbon recovery are disclosed in U.S. Pat. No. 9,376,897 to Ayers et al., all incorporated herein by reference in their entirety.

Many modifications and other embodiments of the present disclosure will come to the mind of one skilled in the art having the benefit of the teachings presented in the foregoing descriptions and the associated drawings. Therefore, it is understood that the present disclosure is not to be limited to the specific embodiments disclosed, and that modifications and embodiments are intended to be included within the scope of the appended claims.

That which is claimed is:

1. A hydrocarbon recovery system comprising:
a radio frequency (RF) source; and
an RF antenna assembly coupled to said RF source and within a wellbore in a subterranean formation for hydrocarbon resource recovery, the RF antenna assembly comprising
first and second tubular conductors,
a dielectric isolator,
first and second electrical contact sleeves respectively coupled between said first and second tubular conductors and said dielectric isolator so that said first and second tubular conductors define a dipole antenna, at least one of said first and second electrical contact sleeves comprising an outer sleeve and an inner electrically conductive liner therein,
an RF transmission line comprising an inner conductor and an outer conductor extending within said first tubular conductor, and
a feed structure coupled to a distal end of said RF transmission line and comprising
a first radially compressible connector coupled to the outer conductor of said RF transmission line to slidably engage adjacent portions of said first electrical contact sleeve,
a second radially compressible connector coupled to the inner conductor of said RF transmission line to slidably engage adjacent portions of said second electrical contact sleeve, and
a dielectric tube coupled between said first and second radially compressible connectors.

2. The hydrocarbon recovery system of claim 1 wherein said inner electrically conductive liner comprises stainless steel.

3. The hydrocarbon recovery system of claim 1 wherein said first radially compressible connector comprises a plurality of first watchband springs; and wherein said second radially compressible connector comprises a plurality of second watchband springs.

4. The hydrocarbon recovery system of claim 3 wherein said RF antenna assembly comprises a plurality of first seals associated with said plurality of first watchband springs, and a plurality of second seals associated with said plurality of second watchband springs.

5. The hydrocarbon recovery system of claim 1 wherein said dielectric isolator comprises a tubular dielectric member and a polytetrafluoroethylene (PTFE) coating thereon.

6. The hydrocarbon recovery system of claim 5 wherein said tubular dielectric member comprises cyanate ester.

7. The hydrocarbon recovery system of claim 1 wherein said RF antenna assembly comprises an insulating coating on said first and second electrical contact sleeves and at least a portion of said first and second tubular conductors.

8. The hydrocarbon recovery system of claim 7 wherein said insulating coating comprises PTFE.

9. A radio frequency (RF) antenna assembly configured to be positioned within a wellbore in a subterranean formation for hydrocarbon resource recovery, the RF antenna assembly comprising:
first and second tubular conductors;
a dielectric isolator;
first and second electrical contact sleeves respectively coupled between said first and second tubular conductors and said dielectric isolator so that said first and second tubular conductors define a dipole antenna, at least one of said first and second electrical contact sleeves comprising an outer sleeve and an inner electrically conductive liner therein;

an RF transmission line comprising an inner conductor and an outer conductor extending within said first tubular conductor; and a feed structure coupled to a distal end of said RF transmission line and comprising a first radially compressible connector coupled to the outer conductor of said RF transmission line to slidably engage adjacent portions of said first electrical contact sleeve, a second radially compressible connector coupled to the inner conductor of said RF transmission line to slidably engage adjacent portions of said second electrical contact sleeve, and a dielectric tube coupled between said first and second radially compressible connectors.

10. The RF antenna assembly of claim 9 wherein said inner electrically conductive liner comprises stainless steel.

11. The RF antenna assembly of claim 9 wherein said first radially compressible connector comprises a plurality of first watchband springs; and wherein said second radially compressible connector comprises a plurality of second watchband springs.

12. The RF antenna assembly of claim 11 further comprising a plurality of first seals associated with said plurality of first watchband springs; and a plurality of second seals associated with said plurality of second watchband springs.

13. The RF antenna assembly of claim 9 wherein said dielectric isolator comprises a tubular dielectric member and a polytetrafluoroethylene (PTFE) coating thereon.

14. The RF antenna assembly of claim 13 wherein said tubular dielectric member comprises cyanate ester.

15. A method for making a radio frequency (RF) antenna assembly positioned within a wellbore in a subterranean formation for hydrocarbon resource recovery, the method comprising:

positioning first and second tubular conductors, first and second electrical contact sleeves, and a dielectric isolator in the wellbore so that the first and second electrical contact sleeves are respectively coupled between the first and second tubular conductors and the dielectric isolator, the first and second tubular conductors defining a dipole antenna, at least one of the first and second electrical contact sleeves comprising an outer sleeve and an inner electrically conductive liner therein;

coupling a feed structure to a distal end of an RF transmission line, the RF transmission line comprising an inner conductor and an outer conductor, the feed structure comprising a first radially compressible connector coupled to the outer conductor of the RF transmission line to slidably engage adjacent portions of the first electrical contact sleeve, a second radially compressible connector coupled to the inner conductor of the RF transmission line to slidably engage adjacent portions of the second electrical contact sleeve, and a dielectric tube coupled between the first and second radially compressible connectors; and positioning the RF transmission line within the wellbore and extending within the first tubular conductor.

16. The method of claim 15 wherein the inner electrically conductive liner comprises stainless steel.

17. The method of claim 15 wherein the first radially compressible connector comprises a plurality of first watchband springs; and wherein the second radially compressible connector comprises a plurality of second watchband springs.

18. The method of claim 15 wherein the dielectric isolator comprises a tubular dielectric member and a polytetrafluoroethylene (PTFE) coating thereon.

19. A radio frequency (RF) antenna assembly configured to be positioned within a wellbore in a subterranean formation for hydrocarbon resource recovery, the RF antenna assembly comprising:

first and second tubular conductors;

a dielectric isolator;

first and second electrical contact sleeves respectively coupled between said first and second tubular conductors and said dielectric isolator so that said first and second tubular conductors define a dipole antenna;

an RF transmission line comprising an inner conductor and an outer conductor extending within said first tubular conductor; and a feed structure coupled to a distal end of said RF transmission line and comprising a first radially compressible connector coupled to the outer conductor of said RF transmission line to slidably engage adjacent portions of said first electrical contact sleeve, a second radially compressible connector coupled to the inner conductor of said RF transmission line to slidably engage adjacent portions of said second electrical contact sleeve, at least one of the first and second radially compressible connectors comprising a watchband spring, and a dielectric tube coupled between said first and second radially compressible connectors.

20. The RF antenna assembly of claim 19 further comprising at least one seal associated with said at least one watchband spring.

21. A radio frequency (RF) antenna assembly configured to be positioned within a wellbore in a subterranean formation for hydrocarbon resource recovery, the RF antenna assembly comprising:

first and second tubular conductors;

a dielectric isolator comprising a tubular dielectric member and a polytetrafluoroethylene (PTFE) coating thereon;

first and second electrical contact sleeves respectively coupled between said first and second tubular conductors and said dielectric isolator so that said first and second tubular conductors define a dipole antenna;

an RF transmission line comprising an inner conductor and an outer conductor extending within said first tubular conductor; and a feed structure coupled to a distal end of said RF transmission line and comprising a first radially compressible connector coupled to the outer conductor of said RF transmission line to slidably engage adjacent portions of said first electrical contact sleeve, a second radially compressible connector coupled to the inner conductor of said RF transmission line to slidably engage adjacent portions of said second electrical contact sleeve, and a dielectric tube coupled between said first and second radially compressible connectors.

22. The radio frequency (RF) antenna assembly of claim 21 wherein said tubular dielectric member comprises cyanate ester.

23. A radio frequency (RF) antenna assembly configured to be positioned within a wellbore in a subterranean formation for hydrocarbon resource recovery, the RF antenna assembly comprising:

first and second tubular conductors;

a dielectric isolator;

first and second electrical contact sleeves respectively coupled between said first and second tubular conductors and said dielectric isolator so that said first and second tubular conductors define a dipole antenna;

an insulating coating on said first and second electrical contact sleeves and at least a portion of said first and second tubular conductors;

an RF transmission line comprising an inner conductor and an outer conductor extending within said first tubular conductor; and a feed structure coupled to a distal end of said RF transmission line and comprising a first radially compressible connector coupled to the outer conductor of said RF transmission line to slidably engage adjacent portions of said first electrical contact sleeve, a second radially compressible connector coupled to the inner conductor of said RF transmission line to slidably engage adjacent portions of said second electrical contact sleeve, and a dielectric tube coupled between said first and second radially compressible connectors.

24. The radio frequency (RF) antenna assembly of claim 23 wherein said tubular dielectric member comprises cyanate ester.

* * * * *